United States Patent [19]

Reeves et al.

[11] Patent Number: 4,948,468

[45] Date of Patent: Aug. 14, 1990

[54] OIL SHALE RETORT APPARATUS

[75] Inventors: Adam A. Reeves, Grand Junction, Colo.; Earl L. Mast, Norman, Okla.; Melvin J. Greaves, Littleton, Colo.

[73] Assignee: The New Paraho Corporation, Lakewood, Colo.

[21] Appl. No.: 313,987

[22] Filed: Feb. 22, 1989

[51] Int. Cl.[5] ..... C10B 1/04

[52] U.S. Cl. ..... 202/93; 202/99; 202/121; 202/211; 202/215; 202/262; 414/162; 432/99; 432/100

[58] Field of Search ..... 202/99, 108, 121, 215, 202/262, 93, 95, 211; 201/34, 40, 36; 48/86 R; 432/96, 99, 100, 200, 242; 34/168, 174, 224, 241; 414/162, 208; 422/232

[56] References Cited

U.S. PATENT DOCUMENTS

| | | | |
|---|---|---|---|
| 2,625,467 | 1/1953 | Barker | 201/34 |
| 3,178,163 | 4/1965 | Jones | 432/100 |
| 4,116,810 | 9/1978 | Jones et al. | 201/34 |

*Primary Examiner*—Joye L. Woodard
*Attorney, Agent, or Firm*—Beaton & Swanson

[57] ABSTRACT

A retorting apparatus including a vertical kiln and a plurality of tubes for delivering rock to the top of the kiln and removal of processed rock from the bottom of the kiln so that the rock descends through the kiln as a moving bed. Distributors are provided for delivering gas to the kiln to effect heating of the rock and to disturb the rock particles during their descent. The distributors are constructed and disposed to deliver gas uniformly to the kiln and to withstand and overcome adverse conditions resulting from heat and from the descending rock. The rock delivery tubes are geometrically sized, spaced and positioned so as to deliver the shale uniformly into the kiln and form symmetrically disposed generally vertical paths, or "rock chimneys", through the descending shale which offer least resistance to upward flow of gas. When retorting oil shale, a delineated collection chamber near the top of the kiln collects gas and entrained oil mist rising through the kiln.

41 Claims, 17 Drawing Sheets

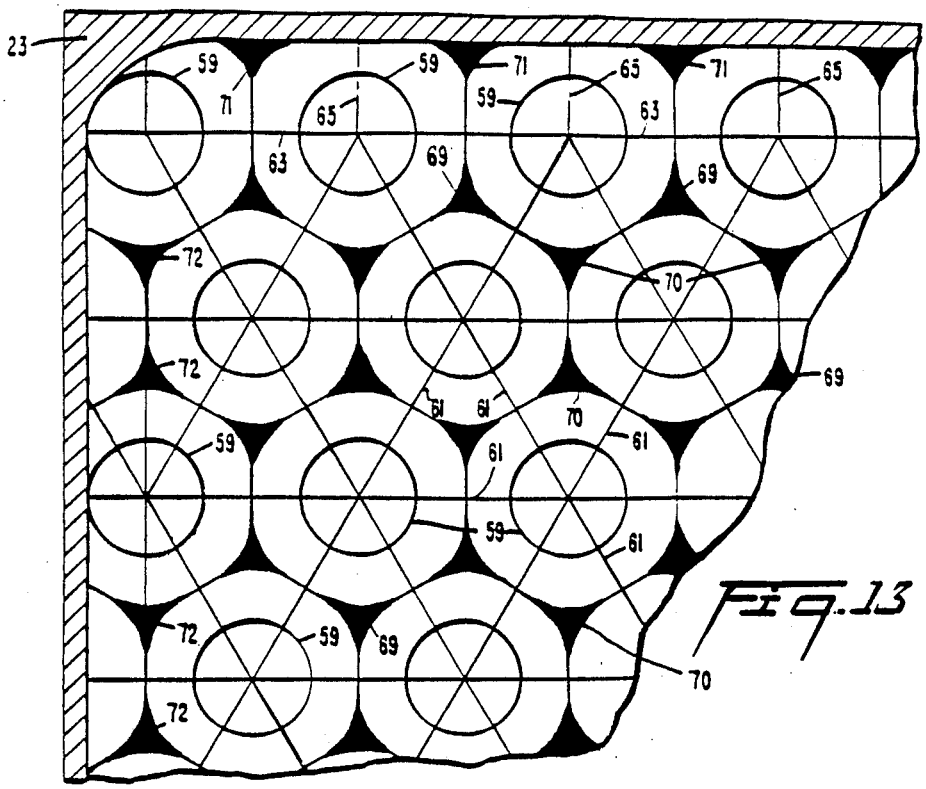
FIG. 13
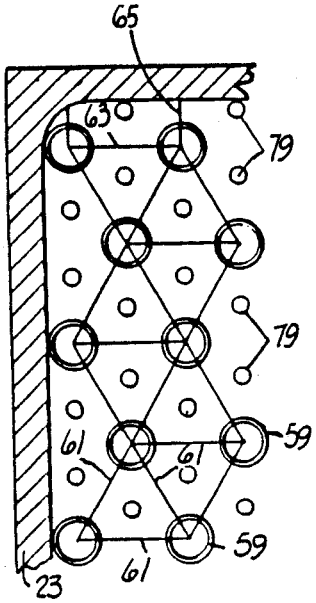
FIG. 12
FIG. 11
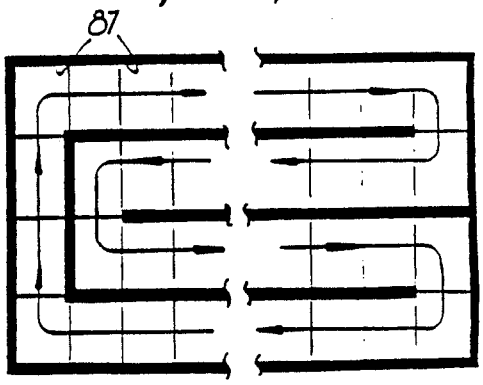

Fig. 16
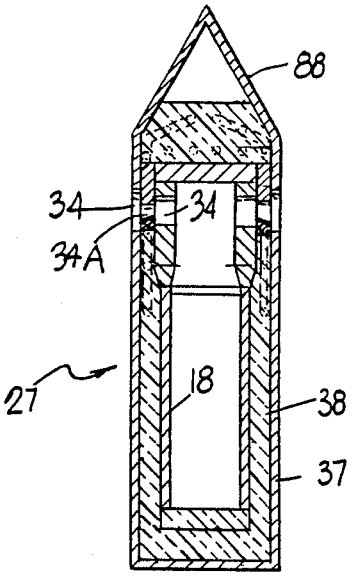
Fig. 18
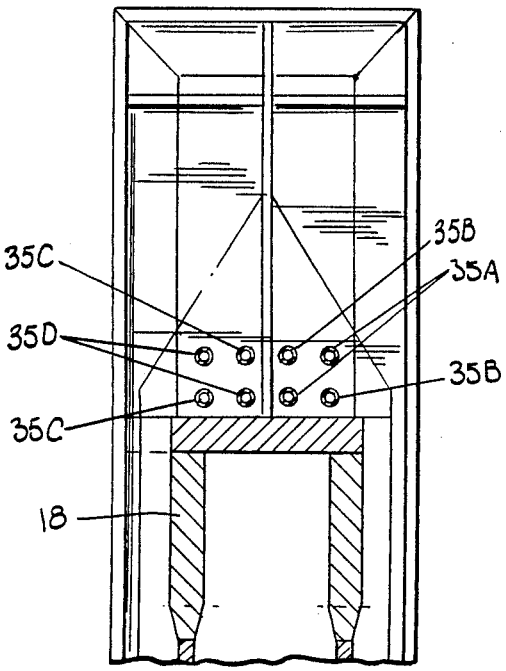
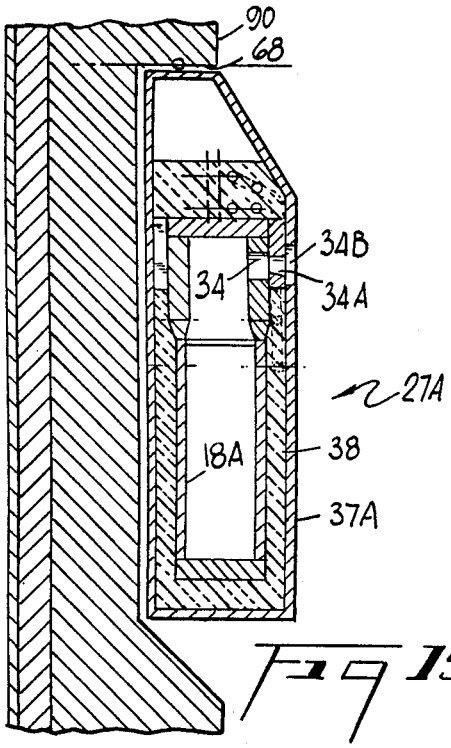
Fig. 19
Fig. 22
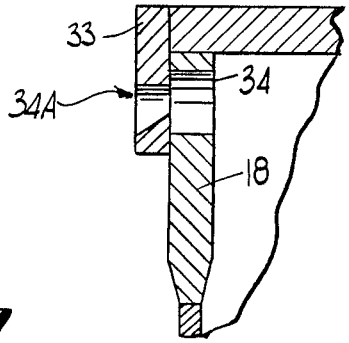

OIL SHALE RETORT APPARATUS

The Government has rights in this invention pursuant to Contract No. DE-FC03-80ET141403 awarded by the U.S. Department of Energy.

BACKGROUND OF THE INVENTION

The present invention relates to an apparatus for processing solid materials by burning, gasifying, calcining or retorting, and more particularly to an improved apparatus for retorting oil shale to recover oil therefrom having a gas distributor system for delivering and distributing thereto gas used in the shale processing. For simplicity, the processes hereinafter described will be referred to as "retorting" processes, and the vessels in which retorting is performed as "retorts" or "kilns ".

One example of solid materials processing in which the present invention finds particular use is in the recovery of oil from oil shale. Oil is recovered from oil shale by heating the shale to its destructive distillation (pyrolysis) temperature. Oil shale contains a high molecular weight organic material known as kerogen. At the destructive distillation temperature, the kerogen in the shale is destructively distilled to produce primarily lower molecular weight organic compounds which are referred to hereinafter as oil and oil vapor. Also produced, are noncondensable organic gases and a solid carbonaceous solid residue ("char"). The oil vapor produced mixes with hot gases from the heating process, then is cooled to condense to a mist, and the mixed gases and oil mist are further processed to recover the oil. It will be appreciated that the efficiency of the destructive distillation process, i.e., the percentage of the total oil capable being produced from the shale that is actually removed and recovered, is critical because it directly affects the cost of the resulting oil.

One type of relatively successful retorting process utilizes combustion (or oxidation) in a kiln containing the shale to develop the heat for the destructive distillation of the shale. This process is referred to as a direct heated process and has met with some success. See U.S. Pat. No. 4,042,485. Another relatively successful process, an indirect heated process, uses externally heated recycle gas to provide the heat for the destructive distillation process. See U.S. Pat. No. 4,116,810. In either case, it is important that the efficiency of the process be maximized. In addition, it is important that the cost of the process be minimized in order to keep down the cost of the recovered oil.

In both the indirect and direct heated methods, it is important that the processing gas be distributed substantially uniformly throughout the cross section of the retort for uniform heating and processing of the shale particles. This is required even though non-uniform conditions may exist in the retort, e.g., different grades of shale materials delivered to the several zones of the retort. Shale grade variations could be in kerogen content, carbonate amount and composition or particle size distribution.

Furthermore, it is important that the shale particles be disturbed as they descend through the retort to expose maximum surface area thereof to heating and to enhance controlled gas to solids content. It is also important that the means for delivering the processing gas be constructed to prevent potentially damaging heat concentration, and to withstand the weight of the descending oil shale bed as well as the high temperatures and other adverse conditions arising in the destructive distillation process.

Another example of solid materials processing in which the present invention is useful is in pyroprocessing of particulate solid materials such as the calcination of limestone. This process generally is a heat treatment of a raw material to produce a chemical change in the material. For example, various carbonates decompose under heat leaving the corresponding oxide, i.e., calcium oxide in lump form, and gaseous carbon dioxide. While each calcining process is dependent upon the material being treated, there are some common general principles which apply when certain types of equipment are used for the process. Thus, the present invention is applicable to calcining generally in vertical retorts, normally referred to as shaft furnaces, vertical kilns, etc. See U.S. Pat. No. 3,743,697.

Various other mineral ores, green petroleum coke in pellet or granular form, and other matter can be subjected to heat treatment in a vertical retort in accordance with the invention.

SUMMARY OF THE INVENTION

The present invention is based upon a countercurrent retort for processing rock, and in particular, lumps of oil shale, limestone, ores and the like. A bed of crushed rock of mixed sizes and shapes descends continuously and generally vertically through several process zones in a vertical kiln. The rock is heated by oxidation in a combustion zone (in the direct heated process) which also makes use of internally recuperated heat. When the rock is oil shale, char remaining on the shale subsequent to the destructive distillation of kerogen is oxidized in the combustion zone. When the rock is, for example, limestone, fuel delivered into the combustion zone is oxidized. A mixture of air and recycled gas is delivered uniformly across the kiln cross section to support uniform oxidation in the combustion zone. In the indirect heated process, hot recycle gas is delivered uniformly across the kiln cross section and heats the descending rock.

In both the direct and indirect heated retorts, the gas distributors are physically positioned within the kiln to contact and disturb the descending rock particles, and are constructed so that each remains at a substantially uniform temperature. In addition, the distributors are constructed to maximize uniformity of gas distribution throughout the kiln cross section. In the direct heated retort for retorting oil shale and in the limestone retorting kiln, the gas distributors preferably are in at least two vertically-spaced levels in the kiln.

The rock is caused to descend as a moving bed of particulate material through the kiln in a manner which produces defined and uniformly distributed vertical zones, or "rock chimneys", which have increased permeability to upward flow of hot gases through controlled areas of the descending rock bed. Hot flue gases from the combustion zone (in the direct heated process) or hot recycled gases (in the indirect heated process) rise upwardly through the rock bed in general and rock chimneys in particular and heat the descending rock to its destructive distillation temperature.

When the rock is oil shale, oil vapor is destructively distilled from the shale in a pyrolysis zone and is swept upwardly through the shale bed, particularly through the rock chimneys, with the hot gases. Incoming shale cools the rising gas/vapor mixture causing the oil vapor to condense to a mist and the gas and entrained mist is collected in a delineated collection chamber above the pyrolysis zone. At the same time, the hot gas/vapor mixture preheats the incoming shale.

The gas/mist mixture is disengaged at a relatively low velocity, and is removed from the collection chamber in a manner further promoting uniform flow. In the direct heated process, cool recycle gas is delivered uniformly across the kiln cross section below the combustion zone and is heated by the hot descending shale and provides a large amount of the required heat for the process by preheating the gas entering the combustion zone.

The present invention provides for the highly uniform destructive distillation of the oil shale which results in exceptional efficiency in the retorting process in both the direct and the indirect heated processes. In addition, the present invention accommodates many variances in materials and equipment to produce uniform, reliable and consistent results.

The gas distributors of this invention are constructed to withstand the weight of the descending rock bed and to inhibit adverse effects thereon arising from the retort process. In addition, the gas distributor system of this invention is adjustable to vary the quantity and composition of the gas delivered to selected areas or zones in the retort to accommodate non-uniform conditions therein and to provide precise control of reaction temperatures.

Additional objects and advantages of the present invention will be set forth in part in the description which follows, and in part will be obvious from the description, or may be learned by practice of the invention. The objects and advantages of the invention may be realized and attained by means of the instrumentalities and combinations particularly pointed out in the claims.

To achieve the objects and in accordance with the purpose of the invention, as embodied and broadly described herein, the retorting apparatus of this invention comprises a kiln having a substantially rectangular cross section, and adapted to have rock of mixed sizes and shapes descend as a moving bed continuously and generally vertically therethrough by gravity, means for delivering gas to the kiln for effecting heating of the rock to its retorting temperature in a pyrolysis zone wherein the gas delivery means comprises a plurality of first and second sets of vertically-spaced gas distributors, each set of distributors including a plurality of elongated, generally parallel conduits extending across the kiln and provided with a plurality of spaced orifices along the length thereof, the distributors being constructed and the orifices being sized and spaced to deliver gas uniformly throughout the cross section of the kiln, the retorting process producing hot flue gases which mix with the other gases in the kiln and flow upwardly in the kiln counter to the direction of movement of the descending rock, means for delivering the rock to the kiln above the pyrolysis zone including a plurality of vertically extending circular feed tubes maintained substantially continuously full of rock and extending downwardly toward the pyrolysis zone, the tubes being substantially uniform in diameter and geometrically arranged so that imaginary lines connecting the centers of each adjacent group of three tubes form approximately equilateral triangles, and imaginary lines connecting the centers of adjacent pairs of tubes adjacent the walls of the kiln and imaginary lines perpendicular to the walls of the kiln and extending through the centers of the last mentioned tubes form rectangles with the walls of the kiln, the rock descending through the tubes and dispersing outwardly at differential rates proportional to the particle sizes, the rock bulk from each tube interacting with the rock bulk from adjacent tubes and with the kiln walls to form a plurality of uniformly and symmetrically disposed, differentially permeable, generally vertical paths, or "rock chimneys", through the descending bed of rock across the entire cross section of the kiln which offer least resistance to upward flow of gases through the descending rock, the rock chimneys being formed one at substantially the center of each equilateral triangle and one near the center of each rectangle, the tubes being sized and arranged to form at least one rock chimney for each five square feet of kiln cross section and when retorting oil shale lumps the upwardly flowing gases being operable to sweep the oil vapor produced upwardly therewith from the pyrolysis zone, the gas and oil vapor being cooled by the descending shale lumps above the pyrolysis zone causing the oil vapor to condense and form a mixture of gas containing oil mist, means defining a delineated collection chamber above the pyrolysis zone for collecting the gas and oil mist mixture rising through the rock chimneys, the shale in the tubes and exiting from the tubes being operable to disengage the gas and entrained oil mist at a low Reynolds number.

Importantly, the collection chamber has a bottom formed with a plurality of uniformly arranged orifices which are aligned vertically with respective ones of the rock chimneys for receiving the gas and oil mist mixture rising through the rock chimneys. The gas, gas/vapor mixture, and gas/mist mixture will seek areas of greatest permeability in the descending shale, and will move to those areas of greater permeability, particularly when encountering resistance to upward flow. The means for delivering gas to the kiln assists here by providing for permeability laterally of the kiln and transverse to the direction of movement of the descending shale. Permeability perpendicular to the gas delivery means and transverse to the direction of movement of the descending shale is provided via the tripper travel layering of shale into the kiln. There is, therefore, three-dimensional permeability throughout the kiln and descending shale bed which further stabilizes and renders uniform the upward flow of gas, oil and oil vapor in the kiln.

In addition, when retorting oil shale lumps, the retorting apparatus of this invention has off-take means disposed laterally of the collection chamber and through which the gas, oil and oil vapor are removed. The off-take means is positioned and the orifices to the collection chamber are sized so that the pressure drop between each orifice and the adjacent off-take means is substantially uniform. Also, a buffer zone is formed between the combustion zone and the pyrolysis zone in the direct heated process. The buffer zone is defined as that horizontal section of the retort between the combustion zone, to the bottom, and the pyrolysis zone, to the top, where the destructive distillation of the oil shale is substantially complete and the oxygen delivered to the combustion zone has been substantially consumed.

Still further, a cooling zone is provided below the combustion zone in the direct heated process and includes grate means which is operable to control the uniform descent and overall processing rate of the moving rock bed through the kiln. Means is provided for uniformly delivering cool recycle gas to the cooling zone uniformly across the kiln cross section. See U.S.

Pat. No. 3,777,940. The descending rock is cooled and the recycle gas is heated and rises toward the combustion zone and provides much of the heat needed for the process. See U.S. Pat. No. 3,401,992.

The rock delivery means includes means for laying down strips of rock in reverse passes along the length of the kiln. In normal operation, there is random variation in rock sizes along the strips of rock. The effect on gas permeability in the rock chimneys is minimized because the rock bed in the retort consists of layers laid down in each pass of the delivery means. Thus, it is unlikely to have two consecutive layers of rock having a non-average distribution of sizes. In the event of restricted flow of gas upwardly through the rock bed, a strip of rock of greater permeability (with a larger average particle size) can be laid down over the restricted zone or adjacent thereto.

The rock delivery means includes a bin of rectangular cross-section connected to each feed tube at its upper end and the juncture between each bin and its associated feed tube includes means for deflecting rock fines toward the centers of the tubes.

In one preferred form of the invention particularly useful for retorting oil shale lumps, the first set of gas distributors are aligned vertically with the second set of distributors. The gas delivered to the kiln can be a mixture of air and recycle gas which is operable to support the oxidation of char in the shale lumps in a combustion zone below the pyrolysis zone. Alternatively, the gas can be recycle or other gas which is heated externally of the kiln to provide the quantity of heat required for the destructive distillation of kerogen in the oil shale.

In a kiln for calcining limestone, the first set of gas distributors can be disposed either generally parallel or generally perpendicular to the second set of distributors.

In a retort having two vertically-spaced sets of distributors, valve means is provided for selectively controlling the quantity of gas delivered to the distributors to control the heat in the kiln. In addition, at least the upper set of distributors is provided with means for varying the quantity of gas delivered to different zones in the retort to accommodate non-uniform conditions in the kiln such as when different grades of shale are delivered to those retort zones and/or to provide precise control of the temperature in the kiln. Also, means may be provided to cool the orifice areas in at least the upper set of distributors particularly in a direct heated retort.

Importantly, the orifices in the distributors are formed in opposite sides of the distributors opposing discharge orifices in adjacent distributors. In accordance with the invention, the discharge orifices are angled downwardly to enhance gas penetration in the rock bed and to prevent rock from entering the distributor orifices in the event that the gas flow is interrupted, and no orifices are formed in the sides of the distributors next adjacent the sides of the kiln. The orifices are substantially uniform in size and are substantially uniformly spaced along the distributors. The orifices adjacent the side walls of the kiln at the entry to the distributors are spaced from those walls a distance less than half the space between adjacent orifices. The distributors may include internal baffle means to cool the distributor walls and which also help assure uniform gas delivery from all orifices and uniform temperature throughout the length of the distributors.

Desirably, the distributors are blocked midway of their length by dividers or center baffles, and the distributors are fed with gas from both ends. The orifices spanning the center baffles are spaced apart a distance greater than the space between other adjacent orifices. The distributors are insulated and structurally designed to withstand the weight of the descending rock while disturbing the rock particles during descent.

In another aspect of the present invention the gas delivery means comprises a plurality of elongated, generally parallel distributors extending across the kiln and provided with a plurality of spaced orifices along the length thereof, the distributors including a plurality of segments corresponding to and aligned with segments of the other distributors, and means for varying the gas delivered to the distributor segments.

In accordance with the invention, the rock is delivered to a plurality of vertical filling zones in the retort which correspond to the various distributor segments. Internal baffles can be used in the distributors to form the segments, and valve means can be provided to vary the gas delivered to the distributor segments.

In yet another aspect of the present invention the gas delivery means comprises a plurality of elongated distributors extending across the kiln and provided with a plurality of spaced orifices along the length thereof, said distributors being open at their ends for the reception of gas, a divider in each of the distributors at substantially the midpoint thereof forming a center baffle blocking the flow of gas therethrough, a horizontal baffle in at least some of the distributors, one on either side of the center baffle and below the orifices, each horizontal baffle sloping downwardly toward the center baffle and having a terminal end spaced from the center baffle, a plurality of orifices in the horizontal baffles, whereby gas entering the ends of the at least some distributors flows below the horizontal baffles in a direction toward the center baffles, some of the gas passing upwardly through the orifices in the horizontal baffles and between the terminal end of the horizontal baffles and the center baffle, the gas exiting the distributors through the orifices therein.

The orifices in the horizontal baffles are formed in opposite edges thereof and are semicircular. Furthermore, the horizontal baffles engage the sides of the respective distributors and are spaced above the distributor bottoms. Desirably the summation of the cross sectional areas of the orifices in each of the horizontal baffles in the distributors containing horizontal baffles is from about 95% to about 125% and preferably about 110% of the cross sectional area of an opening in those distributors below the baffle terminal end and of the cross sectional area of an opening between the baffle terminal end and the center baffle.

In each of the distributors containing horizontal baffles, those baffles together with the sides and bottom of the respective distributors define gas inlet openings by which gas enters the area below the horizontal baffles, and the cross sectional areas of the openings formed below the baffle terminal ends and between the baffle terminal ends and the center baffles is from about 32% to about 28% and preferably about 30% of the cross sectional area of the inlet opening for each of those distributors.

The accompanying drawings which are incorporated and constitute a part of this specification, illustrate one embodiment of the invention and, together with the description, serve to explain the principles of the invention.

BRIEF DESCRIPTION OF THE DRAWINGS

FIG. 11 is a diagram illustrating the rock charging sequence for a four pass charging system;

FIG. 12 is a sectional view of the structure FIG. 5 taken along the line 12—12 thereof;

FIG. 13 is a diagrammatic illustration of the feed tubes and rock chimneys in the kiln;

FIG. 16 is an enlarged sectional view of FIG. 15 taken along the line of 16—16 thereof;

FIG. 18 is an enlarged sectional view of FIG. 17 taken along the line 18—18 thereof;

FIG. 19 is a view similar to FIG. 16, showing a distributor adjacent the retort side wall;

FIG. 22 is a portion of an enlarged sectional view of FIG. 20 taken along the line 22—22 thereof;

DESCRIPTION OF THE PREFERRED EMBODIMENT

Reference will now be made in detail to the present preferred embodiment of the invention, an example of which is illustrated in the accompanying drawings.

Retorting Apparatus

Figure 1:
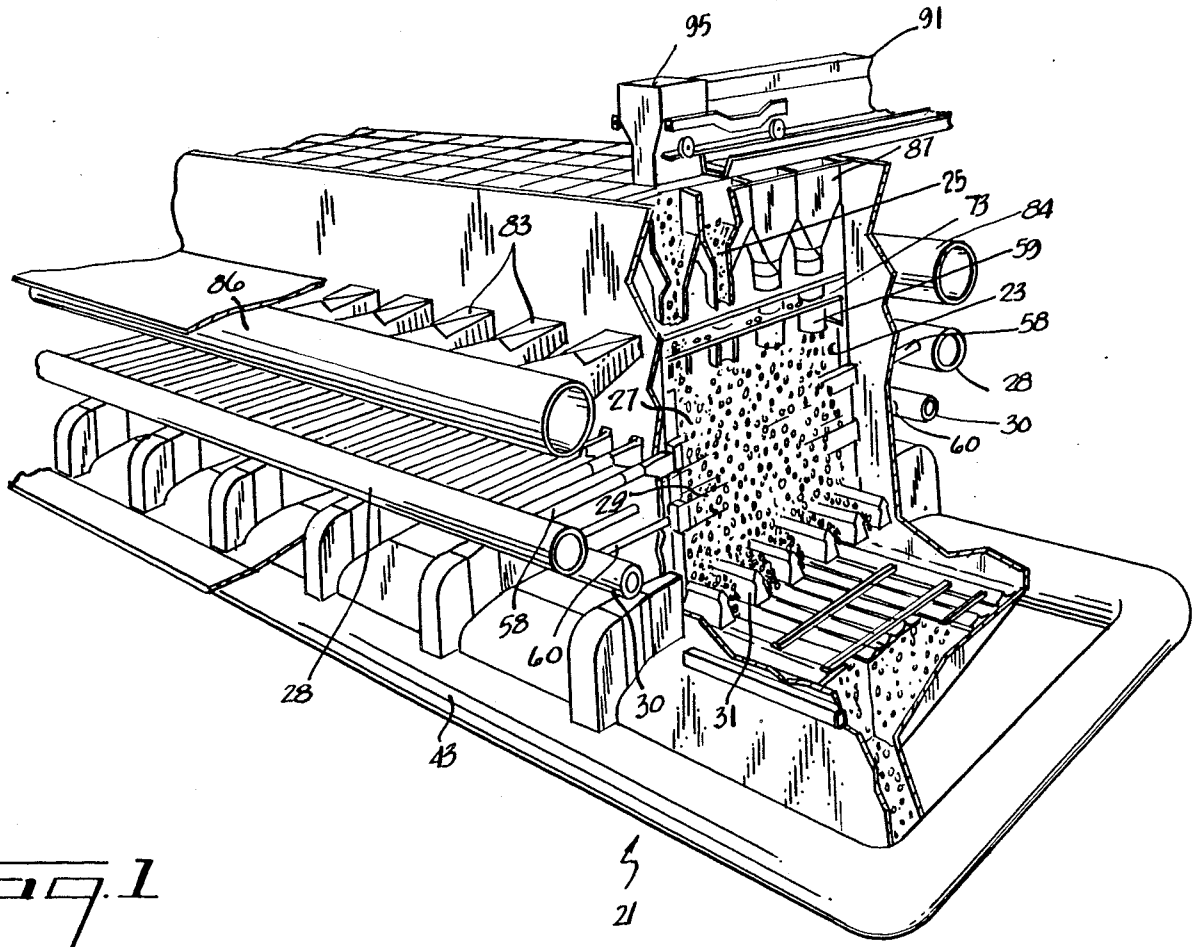
FIG. 1 is a perspective view, partly broken away, of a direct heated retorting apparatus embodying the present invention.

The preferred embodiment of retorting apparatus is shown in FIG. 1 and is represented generally by the numeral 21. In accordance with the invention and as embodied herein, this apparatus includes a vertical kiln 23 which has a substantially rectangular cross section and is adapted to have rock 25 of mixed sizes and shapes descend as a moving bed continuously and generally vertically therethrough by gravity (see also FIG. 5). Prior to treatment in the retorting apparatus, the rock is crushed and screened to form a mixture of lumps of from about ¼" to about 3" dimension across and preferably is free of fines, which are defined as particles less than ¼" across. The rock enters at the top of the kiln 23 and descends therethrough to the bottom.

The preferred embodiment of the invention is illustrated as a direct heated oil shale retort in which oxidation of char in the oil shale occurs in the retort and the hot flue gases produced by the oxidation rise through the descending shale bed and heat the shale particles to their destructive distillation temperature in a pyrolysis zone above the combustion zone. The oil is produced from the shale in the pyrolysis zone by destructive distillation and is entrained and moves upwardly with the hot flue gases. The invention is also useful, as described above, with indirect heated retorts where a combustible gas, usually a recycle gas from the destructive distillation containing little or no free oxygen, is externally heated and is introduced to the retort into the shale bed and provides the heat necessary for the destructive distillation of the kerogen in the shale. One example of an indirect heated retort is disclosed in U.S. Pat. No. 4,297,201 and is incorporated herein by reference.

In accordance with the invention, means is provided for delivering gas to the kiln to effect heating of the descending rock to its destructive distillation temperature. The gas delivery means comprises a plurality of elongated, generally parallel distributors extending across the kiln and provided with a plurality of spaced orifices along the length thereof. In some retorts, particularly in the direct heated retorts and in limestone kilns, it is desirable that there be two or more vertically-spaced sets of gas distributors. The gas delivery means are described in greater detail below.

The mixture of air and gas which is delivered to the kiln 23 by the distributors 27,29 in the direct heated retort supports oxidation in the introduced fuel or in the rock as it descends through the kiln 23. The area or zone in which oxidation occurs is defined as a combustion zones 51, 52 which consist of upper 51 and lower 52 combustion zones (see FIGS. 3, 4, 6 and 8). The heated gas delivered by the distributors 27 and/or 29 in the indirect heated retort rises through the descending bed and heats the rock to its destructive distillation temperature.

It will be appreciated that the amount of air in the air/gas mixture in the direct heat destructive distillation of oil shale controls heat generation and the temperature profile in the kiln. This, in turn, influences the quantity of product yielded and the operability of the process. Oxygen in the air/gas mixture supports the oxidation of char remaining in the shale following the destructive distillation of kerogen in the pyrolysis zone and also oxidizes some of the oxidizable gases in the recycle gas. For some shales, to achieve the greatest efficiencies, the shale temperature in the lower combustion zone 52 reaches a maximum of about 1100° F. and the gas temperature in the upper combustion zone 51 reaches a maximum of 1300° F. and the hot flue gases produced provide most of the heat necessary for the destructive distillation of kerogen.

By providing the vertically spaced distributors 29,27 with low air/gas ratio and high air/gas ratio mixtures, respectively, a partial oxidation or preferential gasification of char zone (the lower combustion zone 52) is defined which extends from the level of the orifices of the upper distributors 27 to the bottom of the kiln. In the preferential gasification of char zone, conditions are maintained substantially as they would be for the gasification of coal. As in the middle distributors 29, a substoichiometric amount of oxygen is introduced through the lower level of distributors 31, thereby maximizing the production of oxidizable gases, predominately carbon monoxide and hydrogen.

There are four sources of oxidizable gases produced in the preferential gasification of char zone in the direct heated retort of oil shale.

1. A substantial amount of heat is transferred from hot gas to the shale without appreciably raising the temperature of the shale. Most of this heat is absorbed by decomposition of carbonate materials and the subsequent reaction of carbon dioxide with hot char. This reaction generates carbon monoxide.

2. Some of this heat is absorbed by reaction between hot char and water vapor in the recycle gas, producing carbon monoxide, hydrogen and small amounts of other gases.

3. The oxygen introduced at the middle distributor 29 partially oxidizes some of the hot char raising the temperature of the upwardly flowing gases. The product of this reaction is also carbon monoxide.

4. Recycle gas is also delivered to the kiln 23 below the middle distributor 29 at bottom distributor 31 in FIG. 4 (hereinafter described), and this gas becomes heated by counter current heat exchange with descending hot shale. The recycle gas normally contains water vapor and additional steam can also be added. Hot char reacts with steam and the products include carbon dioxide and hydrogen.

In accordance with the invention, a cooling zone 54 is created below the combustion zones 51, 52 in the direct heated retort, and means is provided for delivering cool recycle gas to the cooling zone, whereby rock is cooled and said recycle gas is heated and rises toward the lower combustion zone 52. The recycle gas is cool as it enters the cooling zone 54 from bottom distributors 31 and is heated by the rock descending from the lower combustion zone 52. Heat exchange takes place between the recycle gas and the rock in the cooling zone 54 so that the rock is cooled while the recycle gas is heated. The recycle gas then flows upwardly counter to the direction of movement of the descending rock and enters the lower combustion zone 52.

In accordance with the invention, when retorting oil shale the oxidation of char in the lower combustion zone 52 of the direct heated retort produces hot flue gases which mix with the heated recycle gas and flow upwardly in the kiln counter to the direction of movement of the shale. In the indirect heated retort, gas is heated externally and delivered to the kiln. In both cases, the hot gases rise in the kiln and heat the shale to its destructive distillation temperature in a pyrolysis zone 55 to destructively distill oil and oil vapor from the shale. In the direct heated retort, the combustion zones 51, 52 and the pyrolysis zone 55 are substantially horizontal sections of the retort apparatus defined by the conditions present in each zone, or undelineated.

As embodied herein and described above, the recycle gas which has been heated by the descending shale in the cooling zone 54 flows upwardly counter to the direction of movement of descending shale lumps 25 in the direct heated retort. Oxidation of char and oxidizable gases in the combustion zones 51, 52 produces hot flue gases which mix with the hot recycle gas and flow upwardly in the kiln also counter to the direction of descent of the shale lumps 25. The shale temperature in the lower combustion zone 52 reaches a maximum of about 1100° F. and the gas temperature in the upper combustion zone 51 reaches a maximum of about 1300° F. and the mixture of hot flue gases and hot recycle gas heats the shale to a destructive distillation temperature of about 900° F. at which oil vapor is produced therefrom by destructive distillation. Substantially the same destructive distillation temperature, about 900° F., is required in the indirect heated retort.

Figure 4:
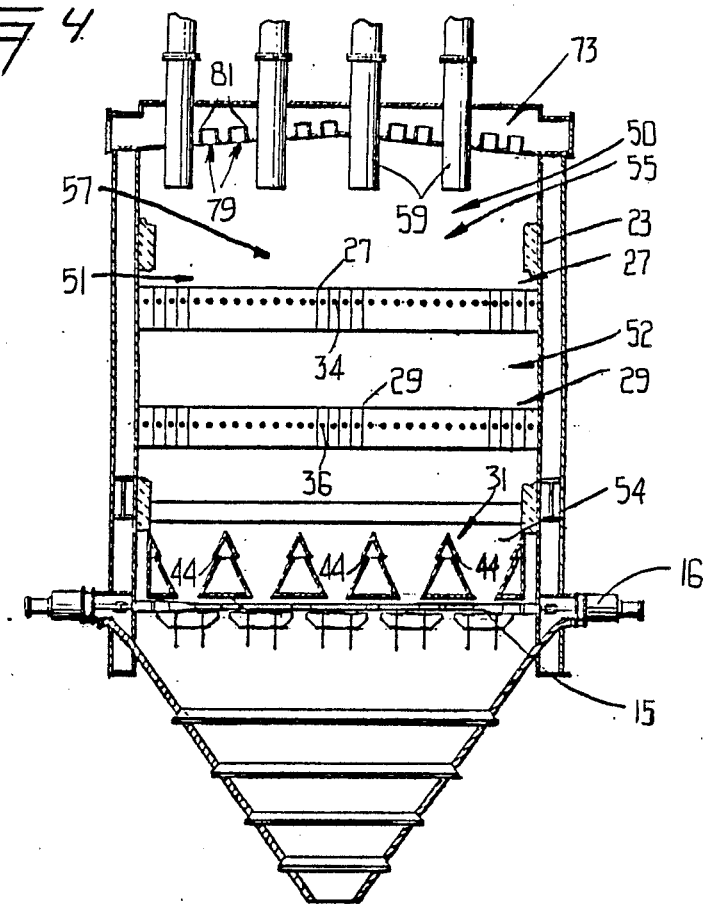
FIG. 4 is an enlarged view of a portion of FIG. 3 with parts removed for clarity.

As shown in FIG. 4, the combustion zones 51, 52 and the pyrolysis zone 55 are undelineated in the direct heated retort. Nevertheless, a buffer zone 57 (FIG. 6) isolates the pyrolysis zone 55 from the combustion zones 51, 52. There is no physical separation, but the effect is the same because substantially all the oil that the oil shale is capable of producing has been destructively distilled out of the shale by the time the shale lumps 25 flow downward into the buffer zone 57. Also, by the time the hot gases flow upward into the buffer zone 57, substantially all the oxygen therein has been consumed.

Rock Chimneys

In accordance with the invention, means is provided for delivering rock 25 to the kiln 23 above the pyrolysis zone 55 including a plurality of vertically extending circular feed tubes 59 maintained substantially continuously full of rock and extending downwardly toward the pyrolysis zone. The tubes are substantially uniform in diameter and are geometrically arranged so that lines 61 connecting the centers of each adjacent group of three tubes form equilateral triangles (see FIG. 13). In addition, lines 63 connecting the centers of adjacent pairs of tubes which are adjacent the walls of the kiln and lines perpendicular to the walls of the kiln and extending through the centers of the tubes adjacent thereto, form rectangles with the walls of the kiln (see FIG. 12). The rock descending through and exiting the tubes disperses outwardly at differential rates proportional to the particle sizes. The larger particles generally tend to disperse away from the line of the tube, while the smaller particles are more likely to flow straight downward. The rock bulk from each tube abuts with the rock bulk from adjacent tubes and with the kiln walls to form a plurality of uniformly and symmetrically disposed differentially permeable, generally vertical paths, or "rock chimneys", through the descending rock across the entire cross section of the kiln. The rock chimneys are made up of generally larger diameter rock particles, which offer least resistance to upward flow of gases through the descending rock. The rock chimneys are formed one at substantially the center of each equilateral triangle and one near the center of each rectangle, and the tubes are sized and arranged to form at least one rock chimney for each five square feet of kiln cross section.

Figure 5:
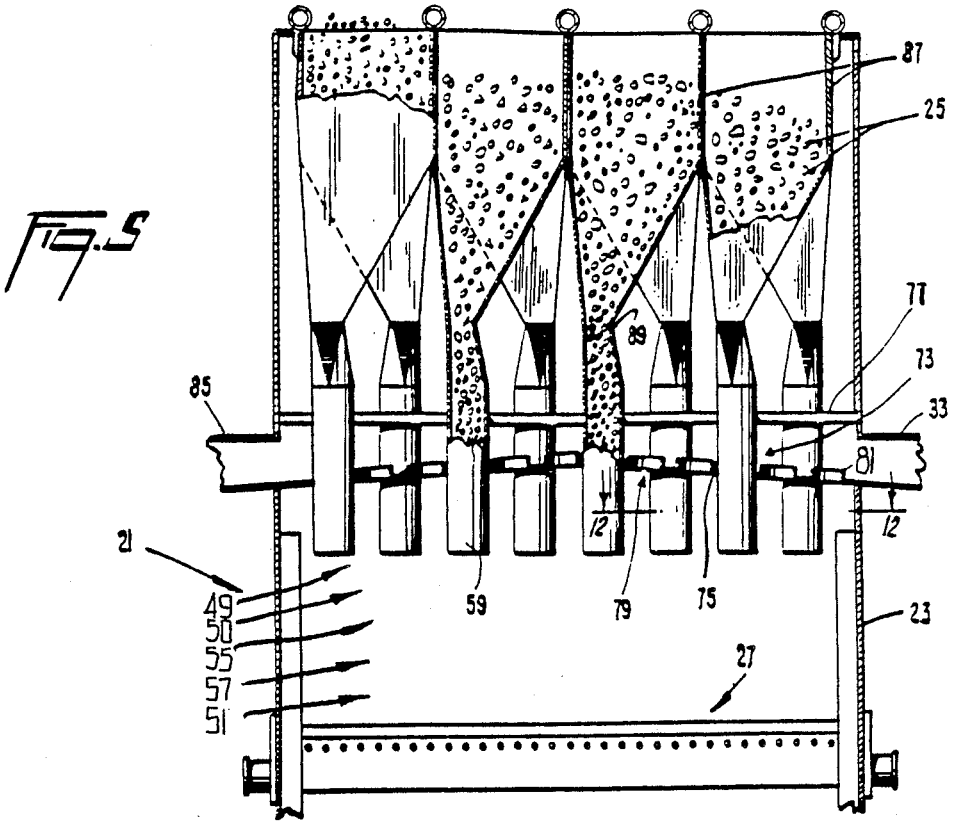
FIG. 5 is an enlarged sectional view of a portion of FIG. 3 and showing the descending rock delivery means.
Figure 6:
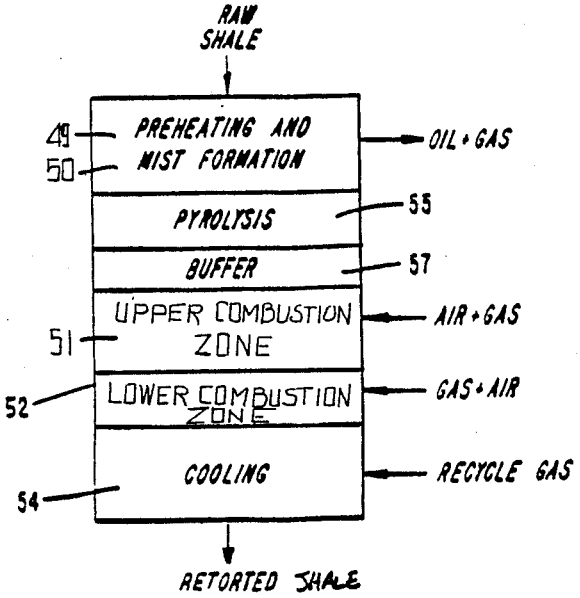
FIG. 6 is a flow diagram illustrating the several zones through which the rock passes during direct heated retorting in accordance with the invention.

As embodied herein, a plurality of circular feed tubes 59 are vertically supported in the kiln 23 and extend downwardly toward the pyrolysis zone 55 (FIGS. 4 and 5). The tubes 59 are substantially uniform in diameter and are geometrically arranged in a repetitive pattern across the kiln 23. As shown in FIG. 13, the tubes 59 are arranged such that imaginary lines 61 connecting the centers of each adjacent group of three tubes 59 form equilateral triangles (See FIGS. 12 and 13). Furthermore, imaginary lines 63 connecting the centers of adjacent pairs of tubes which are adjacent the walls of the kiln 23, and imaginary lines 65 which extend perpendicularly from the walls of the kiln 23 to the centers of the tubes 59 which are adjacent the kiln walls form rectangles with the walls of the kiln 23. (See FIGS. 12 and 13). Such an arrangement of feed tubes provides for a non-random distribution of rock chimneys which all have substantially the same gas permeability characteristics, thereby providing for uniform conditions across the horizontal cross-section of the kiln and resulting in maximum retorting efficiencies.

For the preferable size range of rock herein, the tubes 59 are about 2½ square feet in cross section and feed a retort cross-sectional area of about 10 square feet. As the rock bulk expands horizontally, the larger pieces tend to become distributed uniformly over the 10 square foot area except at the rock chimneys. The rock bed becomes loosened in this expansion so that the small rock particles tend to sift downwardly. The overall effect is a differential in radial rates of rock distribution away from the locations where the rock exits from the feed tubes 59 which is proportional to the particles sizes. The above described placement of the feed tubes, all having these same characteristics, results in the formation of a plurality of uniformly and symmetrically disposed, differentially permeable, generally vertical paths, or "rock chimneys", through the descending rock lumps across the entire cross section of the kiln. These rock chimneys allow a greater volume of gas to contact the areas of the rock bed which has larger average particle size. The remaining areas of the rock bed have smaller average particle sizes and require proportionately less gas. Furthermore, the geometric and repetitive pattern of the tubes 59 provides a geometric and repetitive pattern of rock chimneys throughout the kiln cross section, preferably at least one for each five square feet of kiln cross section. This allows the hot gases rising therethrough to uniformly heat substantially all the shale in the rock preheating and pyrolysis zone 55 above the upper combustion zone 51.

In accordance with the invention, when retorting oil shale the upwardly flowing hot gases in the kiln 23 are operable to sweep the oil vapor which is produced from the descending shale upwardly therewith from the pyrolysis zone 55. The rising mixture of gas and oil vapor then is cooled by the descending shale lumps above the pyrolysis zone causing the oil vapor to condense on nuclei of dust and ions and form a mixture of gas containing an oil mist.

As embodied herein, the upwardly flowing gases and the oil vapor mix together and flow upwardly through the rock chimneys 69,70,71,72 past the descending shale. As the gas and oil vapor flow upwardly, the vapor is cooled and at the same time the descending shale is preheated. When operating under preferred conditions, at approximately 700° F., a significant portion of the oil vapor condenses to a mist and the gas and entrained oil mist continues its journey upward. With further cooling, additional portions of the oil vapors condense as an oil mist.

In accordance with the invention, means is provided defining a collection chamber 73 above the pyrolysis 55 and mist formation 50 zones for collecting the gas and oil mist mixture. The delineated collection chamber has a bottom formed with a plurality of uniformly arranged orifices 79 which are aligned vertically with the rock chimneys for receiving the gas and oil mixture rising through the chimneys. Atmospheric air pressure in the feed tubes 59 resists the flow of gas upwardly through the tubes and the open volume around the tubes above the shale bed and below the orifices serves to disengage the gas and entrained oil mist at a low Reynolds number. Without this open area the oil and mist would condense on the oil shale entering the kiln and be carried back down into the progressively hotter zones of the retort. If the oil and oil mist were subject to substantial turbulence upon entering the collection chamber, significant amounts of the oil would condense on the entering shale and flow back downwards rather than exiting the kiln through the collection chamber.

As embodied herein, and shown in FIG. 5, a collection chamber 73 is formed above the pyrolysis zone 55. The chamber 73 is formed by a bottom panel 75, a roof panel 77, and the walls of the kiln 23. The bottom panel 75 is provided with a plurality of uniformly arranged tubular orifices or openings 79 which are aligned vertically with the rock chimneys 69,70,71,72. The ascending gas and oil mist mixture traveling through the rock chimneys 69,70,71,72, passes through the openings 79 and is collected in the chamber 73. The diameter of the openings 79 are sized so that the pressure drop from each opening to its respective offtake remains uniform for all of the openings.

The rock chimneys 69,70,71,72 provide for uniform upward flow of gases and of gas and oil vapor and gas and oil mist throughout the kiln with a minimum of overall resistance by the descending shale. This not only provides for uniform heating of the shale and the substantially complete destructive distillation of the oil shale, but also permits upward flow of gas, gas and oil vapor, and importantly, gas and oil mist with minimum turbulence. The existence of uniformly spaced rock chimneys 69,70,71,72 provides three fundamental benefits unavailable in retorts taught in the prior art. First, is the systematic and uniform distribution of gases throughout the bed of descending shale. This uniformity allows for more precise temperature controls and more efficient yield of gas and oil from the kerogen found in the shale. In addition, the rock chimneys, along with the strategically placed orifices 79 in the collection chamber 73, provides for an efficient means of collecting the oil and gas mist. Finally, the presence of the rock chimneys reduces the residence time of the distilled gas and oil mist within the body of the retort. Any increase in the residence time of the gas and oil mist proportionately increases the destruction of the products via cracking and coking processes. The rock chimneys provide an efficient means for removing the products from the kiln and maximizing yields by reducing the destructive processes that occur in the kiln body.

If excess resistance to upward flow is encountered at any point, the gas, gas and oil vapor, and gas and oil mist can seek out paths of lesser resistance by moving laterally in the shale bed. Thus, this invention provides three dimensional permeability for upward flow. Thus, the gas and entrained oil mist is disengaged from the shale bed and then from the retort vessel at a low Reynolds number.

Oil mist forms in the kiln 23 just above the pyrolysis zone 55 which, in effect, is a countercurrent heat exchanger. The downwardly moving shale is heated almost to destructive distillation temperature, and the rising gases and vapors are cooled to the temperature of the retort outlet. There is no sharp separation between the pyrolysis zone 55 and the zone 50 where the product is cooled sufficiently to form a mist. Nevertheless, it is believed that a temperature of about 700° F. is the temperature at which a substantial portion of the oil vapor begins to form oil mist.

Collection Chamber

In accordance with the invention, and as shown in FIGS. 4 and 5, the bottom panel 75 of the collection chamber 73 is shown constructed of a tube sheet, i.e., a sheet having tubular members 81 extending upwardly therefrom. The tubular members 81 define the orifices or openings 79. A plurality of off-takes 83,85 are disposed at opposite sides, respectively, of the collection chamber 73 (See FIG. 2). The off-takes 83, 85 communicate with the collection chamber 73 through openings in the side walls of the kiln and extend outwardly therefrom and are connected to manifolds 84,86, respectively, so that the gas and oil mist mixture is easily removed. Means (not shown) applies a uniform suction to the off-takes to insure uniform and smooth flow of the gas/oil mist mixture.

The bottom panel 75 of the collection chamber tapers downwardly from the center of the kiln 23 toward the sides thereof adjacent the off-takes 83,85 with a slope of about 1 inch per 21 inches. The purpose of this slope is to promote drainage of liquid which accumulates on the bottom panel 75. If the slope is too slight, the oil liquid may become static and allow sediment to accumulate. If the slope is too steep, drainage of the liquid may become channeled so that some areas may not be flushed.

Figure 14:
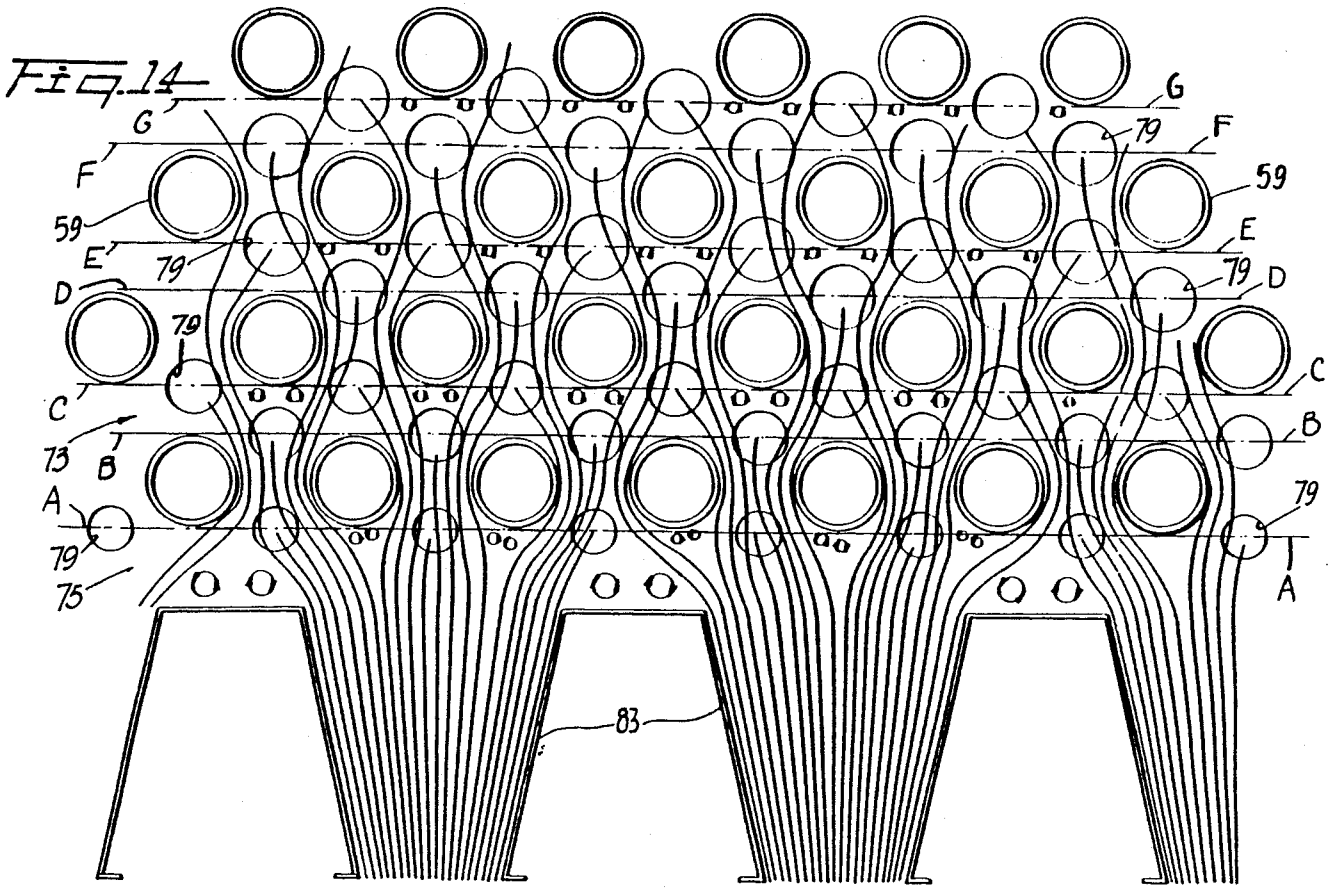
FIG. 14 is an enlarged diagrammatic view illustrating the flow of gas and oil mist from the collection chamber to the off-takes in the present invention.
Figure 15:
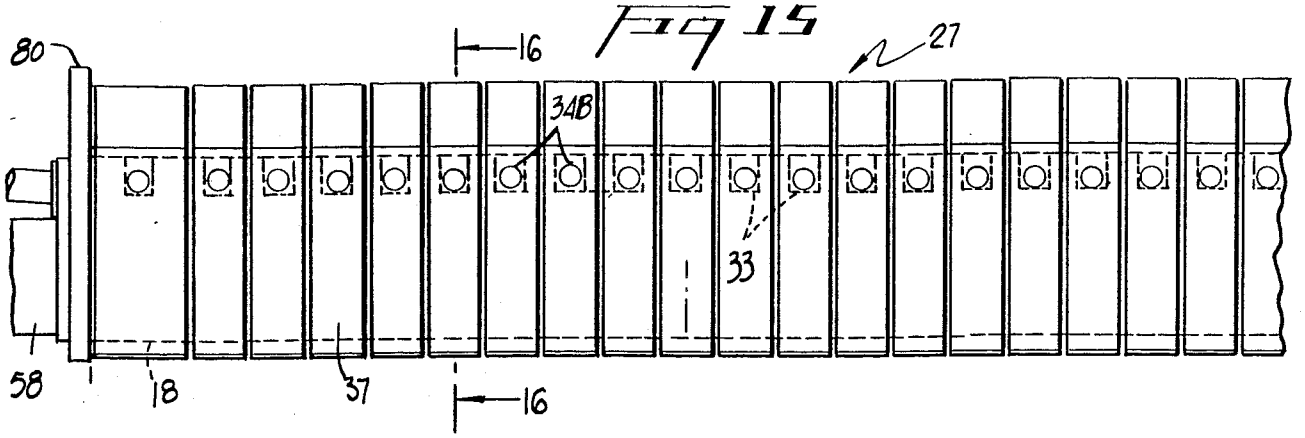
FIG. 15 is an enlarged view of a portion of FIGS. 3 and 4 showing an upper gas distributor.
Figure 17:
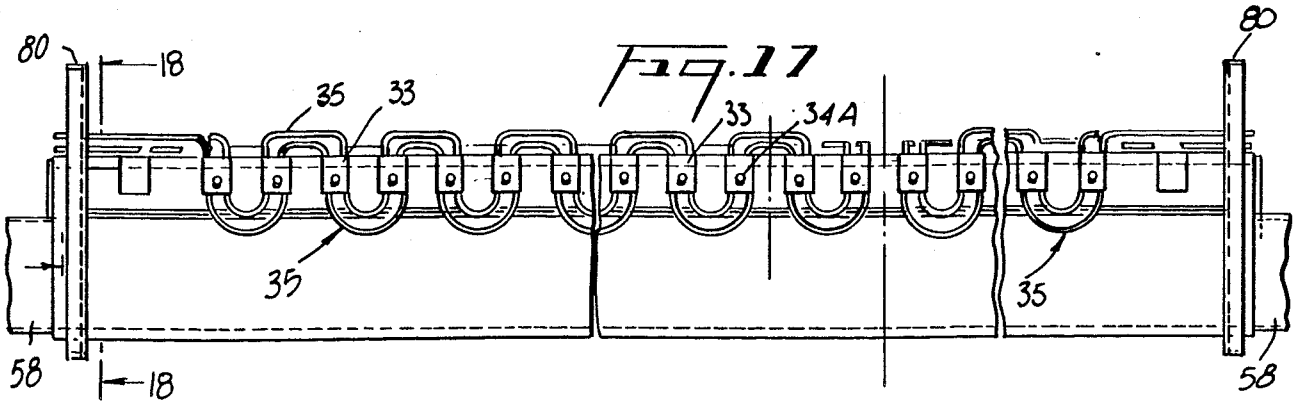
FIG. 17 is a view similar to FIG. 15 with parts removed for clarity.

As further embodied herein and shown in FIG. 14, the openings 79 and tubes 81 increase in size along rows represented by lines A–G which progress away from the off-takes 83 toward the center of the collection chamber 73. The same is true for the openings 79 and tubes 81 on the other side of the chamber center line as they progress away from off-takes 85. The size of each row of openings 79 can be determined once it is understood that it is necessary that the pressure drop from each opening to its adjacent off-take plus the pressure drop through each opening should be uniform in order to achieve the purposes of this invention.

Another factor which must be considered is the existence of the vertical tubes 59 past which the gas/mist must flow. FIG. 14 shows a preferred flow pattern of gas/mist mixture as it emerges from the openings 79 and flows to and through the off-takes 83. It will be appreciated that by properly sizing the openings 79 and by properly sizing the off-takes 83,85, the gas/mist mixture will be withdrawn from the collection chamber 73 and flow outwardly through the off-takes 83,85 with low turbulence. Furthermore, this further enhances uniform disengagement of gas and entrained oil mist across the entire retort cross section.

Rock Delivery

Figure 2:
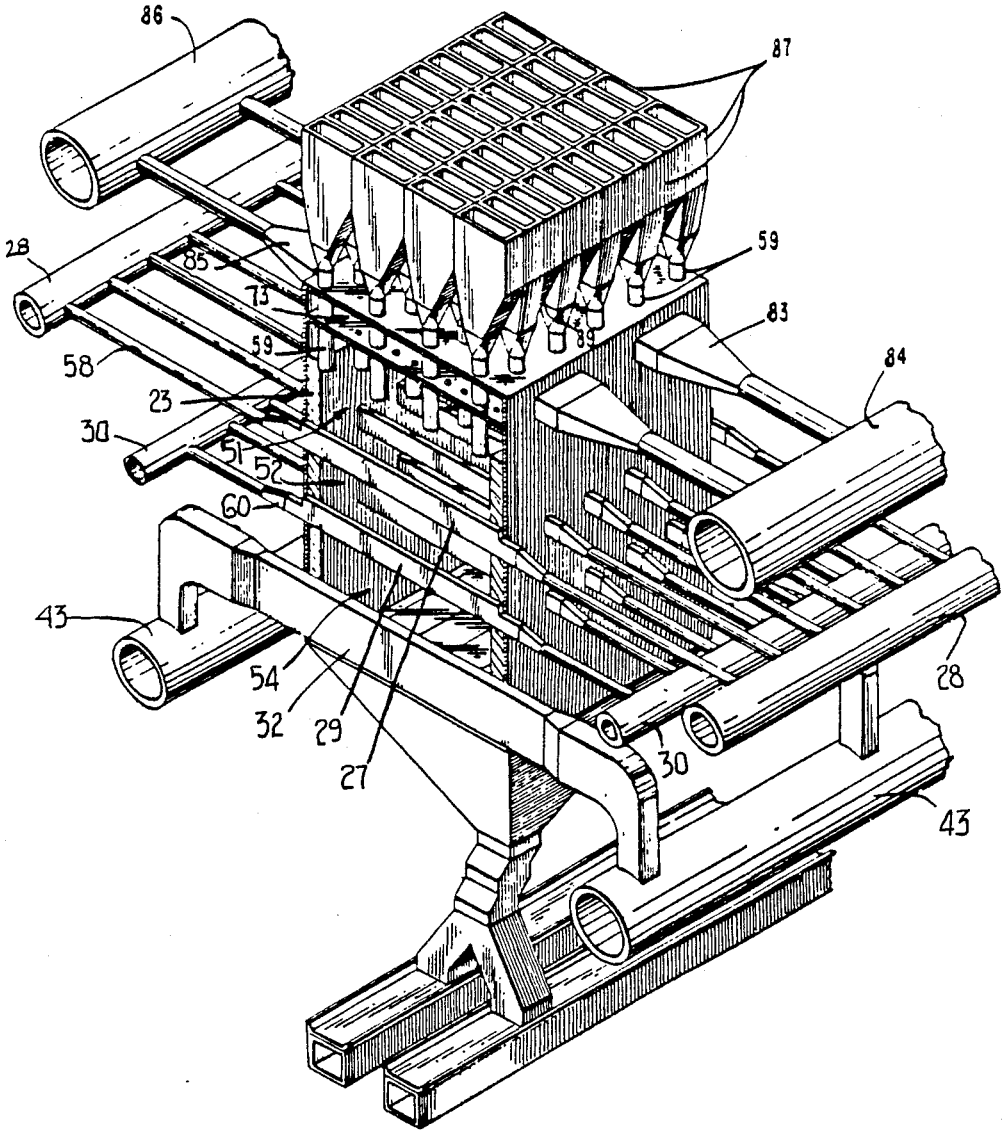
FIG. 2 is a schematic perspective view of a portion of the retorting apparatus of FIG. 1.

In accordance with the invention, and as shown in FIGS. 2 and 5, a bin 87 is disposed above and communicates with each of the tubes 59. The upper portions of the bins 87 which receive the rock are substantially rectangular in cross section and each tapers or funnels downwardly toward its associated tube where it becomes substantially circular in cross-section. In particular, one long sloping side of each bin causes segregation of shale fragments or fines which tend to sift towards the long sloping surface.

In addition, the portion of the bins 87 immediately above the associated tubes 59 is formed with an inwardly directed kink 89 which approaches the center line of the associated tube 59. The kinks 89 deflect the smaller rock fines toward the centers of the tubes 59. However, the kinks 89 should not be so close to the tube center lines to cause bridging of the rock particles. The kinks compensate for size segregation caused by the sloping sides of the bins.

Figure 10:
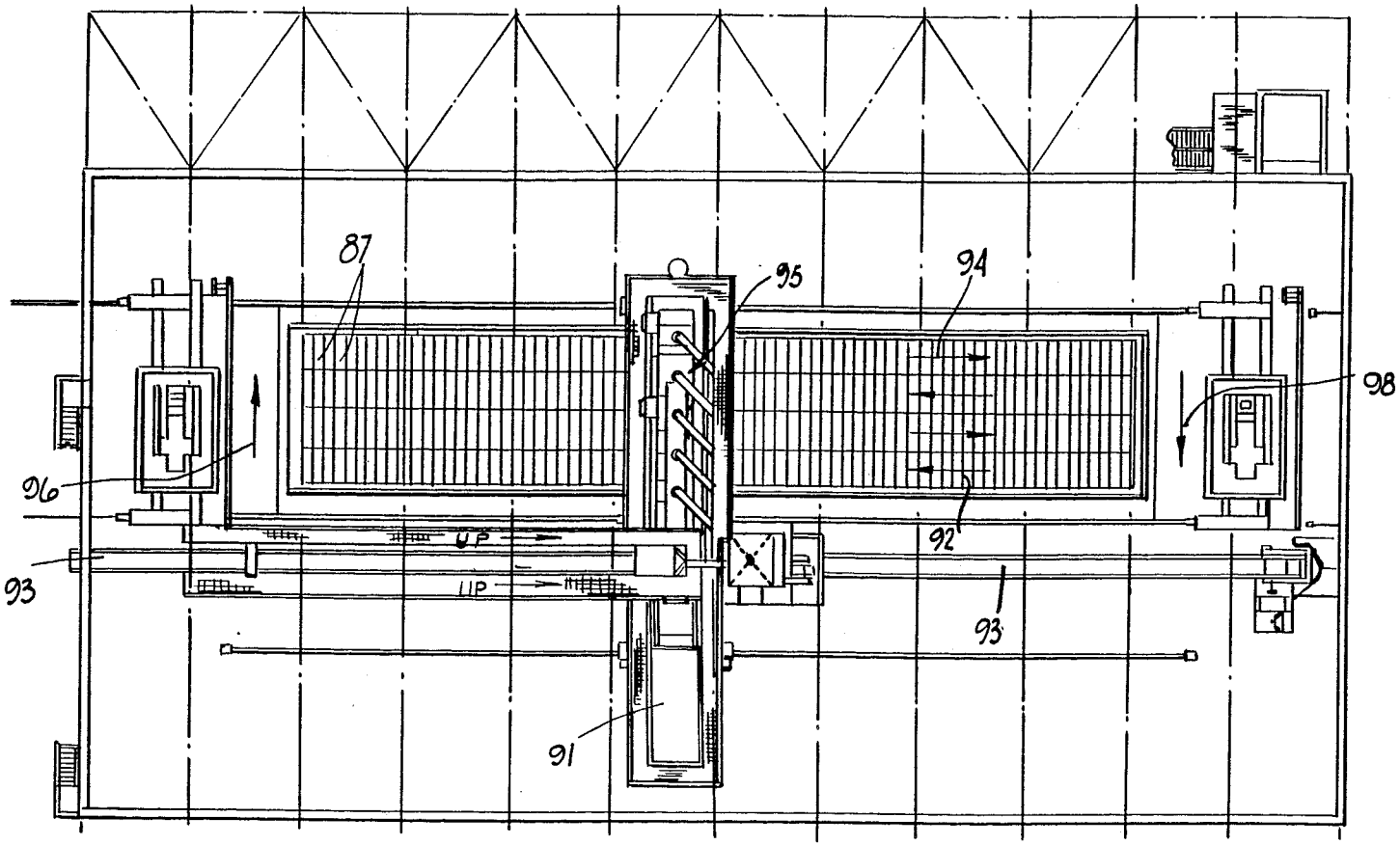
FIG. 10 is a top plan view of the structure of FIG. 1 illustrating the means for delivering rock to the kiln.

In accordance with the invention, the rock delivery means includes a tripper conveyor, a shuttle conveyor, and a traveling hopper which sequentially deliver rock to the bins above the feed tubes. As embodied herein and shown in FIG. 10, a shuttle conveyor 91 is adapted to travel back and forth across the short dimension of the retort. A tripper conveyor 93 running the length of the retort feeds rock onto the shuttle conveyor at each of its positions in the direction of the arrows 92,94. The shuttle 91 also includes a traveling hopper 95 which is adapted to move parallel to the direction of movement of the shuttle conveyor 91 or in the direction of arrows 96,98. The embodiment shown in FIG. 10 includes four rows of bins 87 so that movement of the shuttle conveyer structure, which includes the traveling discharge mechanism of the tripper conveyor 93 as well as the traveling hopper 95, is programmed to be positioned over one bin at a time.

FIG. 11 shows the filling sequence for a total of 320 bins 87, eighty bins in each of four rows. It is noted that the traveling hopper is repositioned only four times on the shuttle conveyor during each filling cycle. The shuttle conveyor travels the full length of the retort in one pass and lays down a strip of shale before reversing and traveling in a reverse pass during which it lays down a parallel strip. This sequential strip feeding method to a series of smaller bins smoothes out the minor variations in size consist and shale grade in the retort cross-section as well as in the vertical direction. Programmed motion controllers reset by rock level detectors maintain desired working levels in the bins.

As described above, if a problem is encountered which restricts upward flow of gas through the descending rock bed, the gas will follow a path of least resistance and will migrate laterally if necessary. With the rock delivery means described above, a strip of rock material having a greater permeability can be laid down over or adjacent the restricted area to aid in promoting uniform, upward flow of the gas.

Grate

In accordance with the invention, the cooling zone 54 includes grate means at the bottom of the kiln which is operable to control the delivery rate of rock from the kiln and the rate of descent of the rock throughout the kiln cross section. As embodied herein, one or more reciprocating grates 15 are provided in the kiln 23 below the bottom gas distributors 31 and in the openings between them. (See FIG. 4). The retarder plates are wider than the openings and prevent the free flow of rock. The grates 15 are positioned on top of the retarder plates and are reciprocated by suitable means such as hydraulic or pneumatic cylinder and piston devices 16 and provide for pushing the rock off the retarder plates, thus providing for removal of spent rock from the bottom of the kiln uniformly across its entire cross section. This, in turn, provides for uniform descent of the rock through the kiln 23. The rate of discharge of rock from the kiln 23 and the rate of rock descent in the kiln can be varied by varying the grate bar reciprocation rate. Furthermore, by differential adjustment of the grate bar reciprocating rates, fine tuning can assure uniform shale processing rates across the full cross-section of the retort.

Gas Delivery

In accordance with the invention, means is provided for delivering gas to the kiln to effect heating of the descending rock to its retort temperature. Said means can be two sets of gas distributors including a plurality of generally parallel conduits which extend across the kiln. Preferably, the upper distributors 27 are open at their ends for the reception of gas and are blocked substantially at their midpoint as will be described below. A pair of manifolds 28, 28 are connected by pipes 58 to opposite ends of the distributors 27 (see FIGS. 1, 2 and 3). The manifolds 28 also are connected to a gas source (not shown) so that gas delivered to the manifolds 28 passes through the pipes 58 into the distributors 27 and enters the kiln 23 through orifices 34.

Similarly, the middle distributors 29 are open at their ends for the reception of gas and are blocked at substantially their midpoint. A pair of manifolds 30, 30 are connected by pipes 60 to opposite ends of the distributors 29. The manifolds 30, 30 are also connected to a gas source (not shown) so that gas delivered from the source to the manifold 30 flows into the distributors 29 and enters the kiln 23 through the orifices 34.

Figure 3:
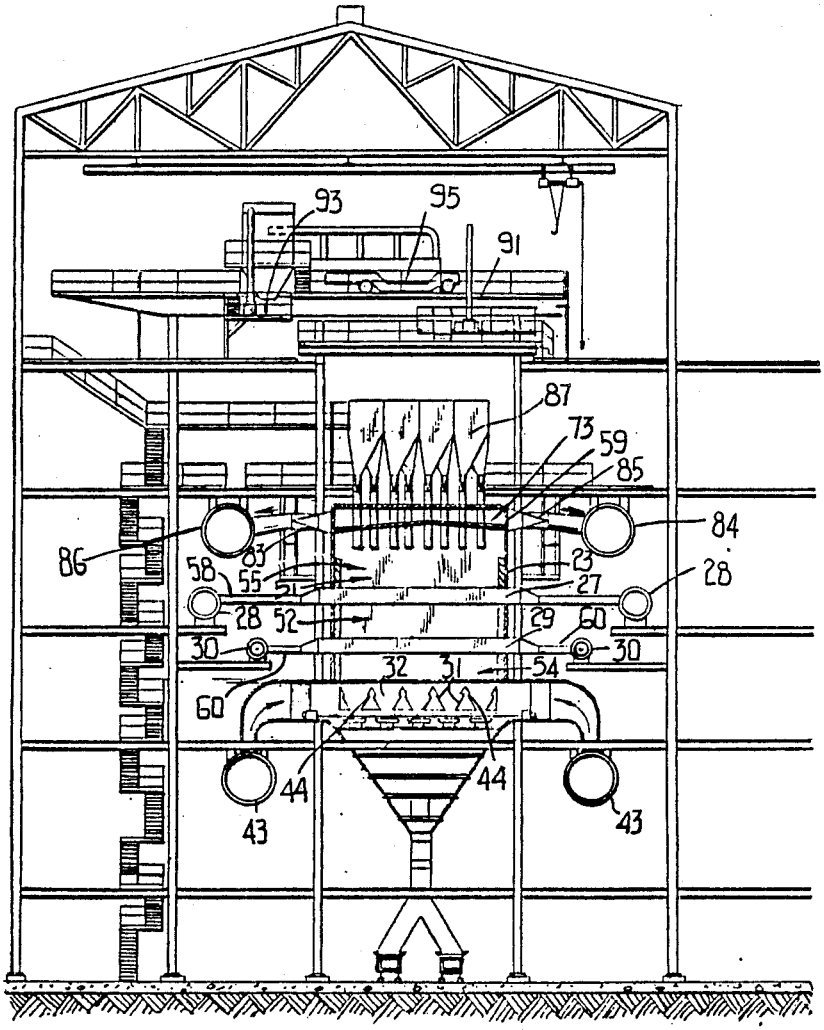
FIG. 3 is a vertical sectional view of the structure of FIG. 1.

In the direct heated retort used to retort oil shale, the gas entering the kiln 23 by way of the distributors 27, 29 is a mixture of air and recycle gas and is used to support oxidation of char in the descending shale. Oxidation occurs in combustion zones 51, 52 in the kiln 23 which extends from the distributors 27, 29 upwardly as much as one or two feet (FIGS. 3 and 4). The hot flue gases produced by oxidation rise through the descending shale bed and heat the shale particles to their destructive distillation temperature in a pyrolysis zone 55 which is located above the upper combustion zone 51. The air/gas ratios are different in the upper and middle sets of distributors 27, 29, the ratio in the upper distributors 27 being from about 3.0 to about 5.0, while the ratio in the middle distributors 29 is from about 0.5 to about 0.8. Oxygen in the air/gas mixture supports the oxidation of char in the shale and also oxidizes some of the oxidizable gases in the recycle gas. Desirably, the shale temperature in the upper combustion zone 51 reaches a typical value of about 1000° F. and the gas temperature reaches a typical value of about 1250° F. and the hot flue gases produced provide most of the heat necessary for the destructive distillation of the kerogen in the shale.

The temperature of the hot flue gases from oxidation is moderated by the presence of recycle gas flowing upwardly through the rock bed, having been injected by way of bottom distributors 31 at the bottom of the retort.

When retorting oil shale in the indirect heated retort, the gas for destructive distillation may be delivered into the rock bed by a single set of distributors although two or more sets such as first and second vertically-spaced sets of distributors 27, 29 may be used. In the indirect heated retort, the gas is usually recycle gas from the destructive distillation or a gas containing little or no oxygen. This gas is externally heated and is introduced to the kiln and provides the heat necessary for the destructive distillation of kerogen in the shale. Details of the manner of utilizing recycle gas from destructive distillation in an indirect heated oil shale retort are described in U.S. Pat. No. 4,116,810.

In both cases, i.e., the direct and indirect heated retorts, the gas distributors which serve to deliver gas to the kiln for destructive distillation also serve to disturb the descending rock particles. In the case where two or more vertically-spaced sets of distributors are used, the rock particles are disturbed at a corresponding number of vertically-spaced locations in the kiln 23. In all cases, the surface area of the particles which are exposed to heat in the kiln is maximized which enhances the efficiency of the process.

The spaced sets of distributors 27, 29 are shown vertically aligned with one another. It will be appreciated, however, that the distributors 27, 29 could be staggered which might serve to increase the extent to which the rock particles are "disturbed" in their descent through the retort. However, it is believed that a staggered configuration might be disadvantageous, particularly in the direct heated retort used to retort oil shale where it might interrupt the formation of a buffer zone 57 which is formed between the upper combustion zone 51 and the pyrolysis zone 55. The buffer zone 57 (FIG. 6) is above the upper distributors 27 and below the pyrolysis zone 55 and isolates the pyrolysis zone 55 from the upper combustion zone 51.

Substantially all the oil that the oil shale is capable of producing will have been removed from the shale by the time the particles reach the buffer zone 57, and by the time the hot rising gases in the retort reach the buffer zone 57, substantially all the oxygen therein will have been consumed. If the buffer zone 57 is interrupted or is non-continuous, it may be physically possible for some of the shale to pass through without the oil having been removed so that the oil will be released from the shale in the high temperature upper combustion zone 51 below the buffer zone 57. This oil would subsequently pass upwardly through an oxygen containing level in the vicinity of the upper distributors 27 and would be oxidized to the extent of oxygen availability, thus reducing the efficiency of the process.

In both the direct and indirect heated retort, a set of bottom distributors 31 is provided near the bottom of the kiln 23 (FIGS. 2 and 3). The bottom distributors 31 include a plurality of elongated, generally parallel distributors which extend across the kiln 23 in a direction transverse to the distributors 27, 29. The bottom distributors 31 are provided with orifices 44 and are connected to manifolds 32 which in turn are connected to a gas source (not shown). The gas delivered to distributors 31 in an oil shale retort is a cool recycle gas which enters the bottom of the kiln 23 and rises toward the lower combustion zone 52. This forms a cooling zone 54 in which the descending shale is cooled. By heat exchange, the recycle gas from distributors 31 is heated as it rises toward the combustion zones 51, 52.

In a direct heated retort for calcining limestone, a gaseous fuel is used for oxidation. An air-gas mixture is introduced into the kiln preferably at three zones controlled by distributors 31, 29, 27 (FIG. 4). When natural gas is used, the percentage of gas mixed with air in each of the zones is about 0.2 to 2.5% gas by volume in the mixture for the bottom zone fed by distributors 31, about 8% to 70% gas by volume in the middle zone fed by distributors 29, and about 6% to 20% gas by volume in the upper zone fed by distributors 27. Preferably, for limestone calcination the percentage volume of gas for the lower zone is about 0.3% to 1.0%, for the middle zone about 25% to 45% and for the upper zone about 10% to 15%. These mixtures give a very great excess of air for oxidation (based on the gas) in the lower zone, a very moderate excess in the middle zone, and a very small overall excess of air, preferably under 25%. The temperature in the combustion zones 51, 52 is hot enough (over 2000° F.) to calcine, i.e., decompose, limestone.

It is important that the distributors deliver gas to the kiln 23 substantially uniformly throughout the kiln cross section so that the descending rock bed is uniformly heated for maximum processing efficiency. It is important also that the distributors be constructed to prevent excessive heat concentration from occurring at the center of the kiln. Finally, the distributors must be constructed to retard clogging and to withstand the force of the descending rock bed. In high temperature processing of solids by vertical kilns, e.g., limestone calcination or roasting of mineral ores, some of the distributors may need to be cooled at their exit orifice cooling areas by circulating liquid.

The distributors should be constructed so that gas flow therethrough can be controlled to control the heat in the retort, and so that different quantities of gas can be delivered to different horizontal zones of the retort should non-uniform conditions exist in the retort. Such non-uniform conditions can arise, for example, when non-uniform grades of rock are delivered to the retort by the delivery means.

In accordance with the invention, the gas distributors are constructed and the orifices in the distributors are sized and spaced to deliver gas uniformly throughout the cross section of the kiln. As embodied herein and shown in FIGS. 15–22 for the direct heated retort, the upper gas distributors 27 are substantially identical and each includes a hollow, elongated, generally rectangular frame 18 which is constructed, for example, of carbon steel and is blocked at substantially its midpoint by a divider or center baffle 40 (see FIGS. 20 and 21). The distributor frames 18 extend entirely across the width of the kiln 23 and are supported at opposite ends in metal frames 80 within the side walls of the kiln.

Openings 34 exist along both sides of the frames 18 (see FIG. 22). A plurality of expanding nozzles 33, also constructed of carbon steel, are welded to the frames 18 over each of the openings 34, and each expanding nozzle 33 is formed with a conically-shaped opening 34A aligned with an associated opening 34. As shown in FIG. 22, the axes of the conically-shaped openings 34A are inclined downwardly at an angle of about 15° relative to the horizontal to increase horizontal penetration of injected gas. In addition, the minimum diameter of the orifices, which occurs at the section of the conical openings 34A adjacent the frame openings 34, is selected to prevent rock particles from working their way inside the distributors 27. For rock particles which are from about ¼" to about 3" average dimension across, the orifice diameter should be from about ¾" to about 1".

As shown in FIG. 16, the distributor frames 18 are each encompassed by a protective armor plate 37 which may be constructed, for example, of stainless steel, to protect the distributor against the excessive heat in the kiln. The armor plates 37 are provided with openings 34B which align with the openings 34 and 34A in the frames 18 and expanding nozzles 33 respectively, and are generally rectangular in cross section with a peak-shaped top 88 which first encounters the descending rock. Distributors 27A adjacent to each end wall 90 of the kiln 23 are each partially set into recesses 68 in the kiln walls (FIG. 19). The armor plates 37A used with these distributors 27A have a tapered rectangular configuration as shown in FIG. 19. The modified armor plates 37A do not have openings in the sides adjacent the kiln walls. Insulation 38 may be disposed in the space between the armor plates 37, 37A and the frames 18, 18A of all distributors 27, 27A.

The structural design of the upper gas distributors 27 is based on the assumption that all the rock above a central portion along the length of the kiln is carried by beam action. For the small zones adjacent the kiln end walls, the usual triangular loading pattern is assumed. The calculated static loads are multiplied by a factor, preferably about 1.2, to allow for the effect of the dynamic movement of the rock.

The top flange on the distributor frames 18 is assumed to be laterally unsupported even though the rock normally provides some support against buckling. However, since the rock is moving and the movement may be different on the two sides of the retort, a lateral load can and will exist on the distributors. A maximum calculated temperature is used to estimate the modulus of elasticity of the metal under moving bed conditions. In a direct heated oil shale retort where the upper distributors are cooled (hereinafter described), the maximum calculated temperature for the distributor frame 18 is about 700° F.

A higher maximum temperature, about 900° F., is used to estimate the required compressive strength of the distributor frames 18 under static conditions when buckling is not a factor. This temperature is based on the worst case thermal condition from observation of thermocouple readings during power outages and the knowledge that the endothermic reactions continue for a short period while the exothermic reactions stop when the gas supply is shut off.

With respect to gas flow, the function of the distributors 27, 29, 31 is to introduce the proper amount of gas at the location where it is needed under controlled conditions. In a direct heated retort used to destructively distill oil from oil shale, the distributors 27, 29, 31 contain a controlled mixture of recycle gas and air which is below the point of auto-ignition at normal operating temperatures inside the distributors. The minimum velocity of gas through the orifices desirably is maintained above 33 ft./sec. to prevent flashback into the distributor from the shale where oxidation is occurring. The minimum orifice velocity also assists in distributing the gas laterally in the rock bed.

The pressure drop across the orifices is selected to be about 10 times the velocity head of the gas upstream of the first orifice. The quantity (scfm) of gas introduced to each orifice should fall within a narrow band, within 5% of each other, to insure uniform gas distribution to the retort. This quantity, expressed mathematically, is proportional to:

$$\Delta P/TA$$

where $\Delta P$ is the pressure drop across the orifices and TA is the absolute temperature of the gas.

Particular problems are encountered in achieving this result. Any orifice physically located near the entrance "sees" an effective $\Delta P$ equal to the total head less the velocity head which is a maximum at the point of entrance. This results in a lower $\Delta P$. Also, the gas experiences a pressure increase as it approaches the center baffle 40 causing an increase in flow rate especially at the last orifice adjacent the center baffle 40.

These problems can be solved and uniformity of gas flow to all orifices achieved by varying the size of the orifices. However, this presents another problem in that it requires different-sized tools when manufacturing and cleaning the orifices. Also, it presents a danger that smaller-sized orifices can be damaged by a tool sized for a larger orifice.

In accordance with the invention and as embodied herein, the distributors 27, 29 have uniformly-sized orifices and yet provide for uniform gas delivery to the retort by spacing the first orifice closer to the wall of the retort than half the spacing between the other orifices, and spacing the orifices which straddle the center baffles 40 further apart than the other orifices. The spacing between the remaining orifices is substantially equal. For a rectangular retort spanning 24 feet and having pairs of 12 foot long distributors 27, 29 (one on each side of the center baffles 40) and each distributor of the pairs fed with gas from one end, and having a minimum orifice diameter of about 0.900", the spacing between adjacent orifices is about 8", the spacing between the orifices which straddle the center baffle is about 8½", and the spacing between the wall of the kiln and the first orifice is about 3¾".

Gas Cooled Distributors

It will be appreciated that uniform velocity and mass flow of gas from all of the orifices can be achieved only if the temperature can be held within a relatively-narrow range. Furthermore, in the direct heated retort, the maximum wall temperature of the distributors 27 is limited by the possibility of premature combustion. These requirements are mutually incompatible in a distributor constructed as a simple perforated pipe.

Importantly, if the distributors are constructed as simple perforated pipes, it will be understood that the walls of the distributors become very hot near the center of the kiln. The gas flow rate varies along the distributors as does the velocity head reaching a minimum at the center of the kiln causing the distributors to be much hotter at the kiln center than toward the side walls. The distributors which are—in effect—box girders, can collapse if they become too hot. Further, the gas in contact with the hot distributor walls may oxidize further increasing the temperature and magnifying the problem.

In accordance with the invention, a "horizontal" (actually sloping slightly downwardly from the sides of the kiln) baffle is provided, (in at least some of the distributors), one on either side of the center baffle and below the distributor orifices. Each of the horizontal baffles slopes downwardly toward the center baffle, has a terminal end spaced from the center baffle, and is provided with a plurality of orifices, whereby gas entering the ends of the at least some distributors flows below the horizontal baffles in a direction toward the center baffles, some of the gas passing upwardly through the orifices in the horizontal baffles and some between the terminal end of the horizontal baffles and the center baffles, the gas exiting the distributors through the orifices therein. The horizontal baffles take into account heat flow through the insulated distributor walls, the pressure drop between the distributor inlet and each orifice, and the temperature, pressure and velocity conditions at each orifice, and provide for a desirable flow pattern in the gas flowing through the distributors.

Figure 20:
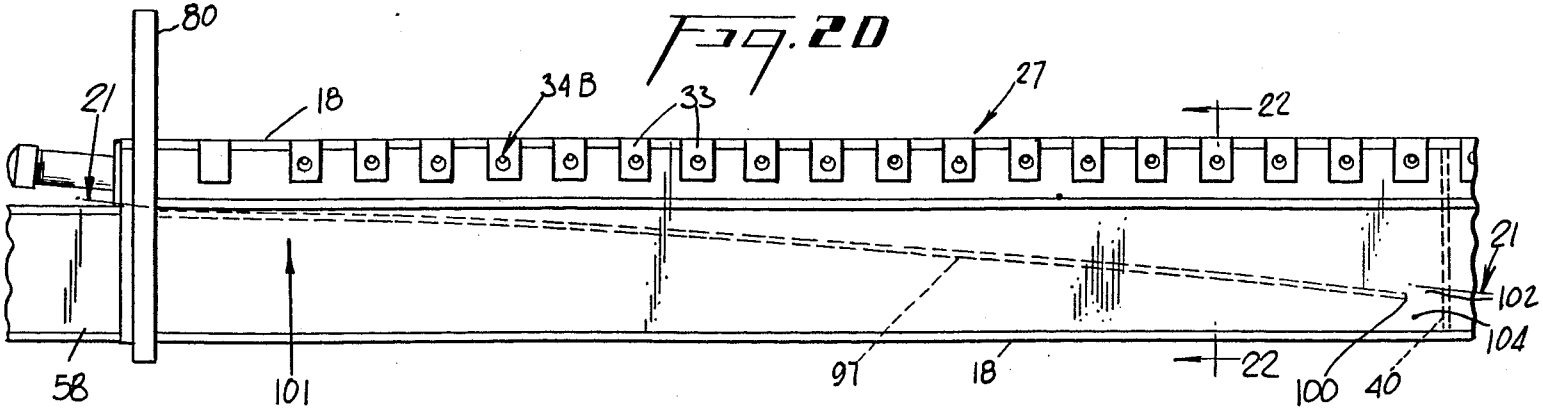
FIG. 20 is a view similar to FIG. 15 with parts omitted for clarity.
Figure 21:
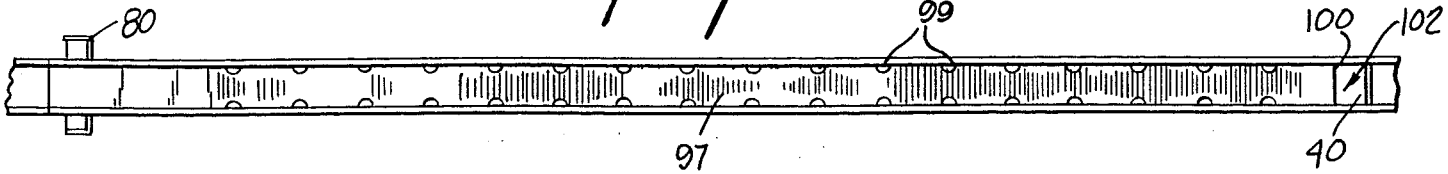
FIG. 21 is a sectional view of FIG. 20 taken along the line 21—21 thereof.
Figure 23:
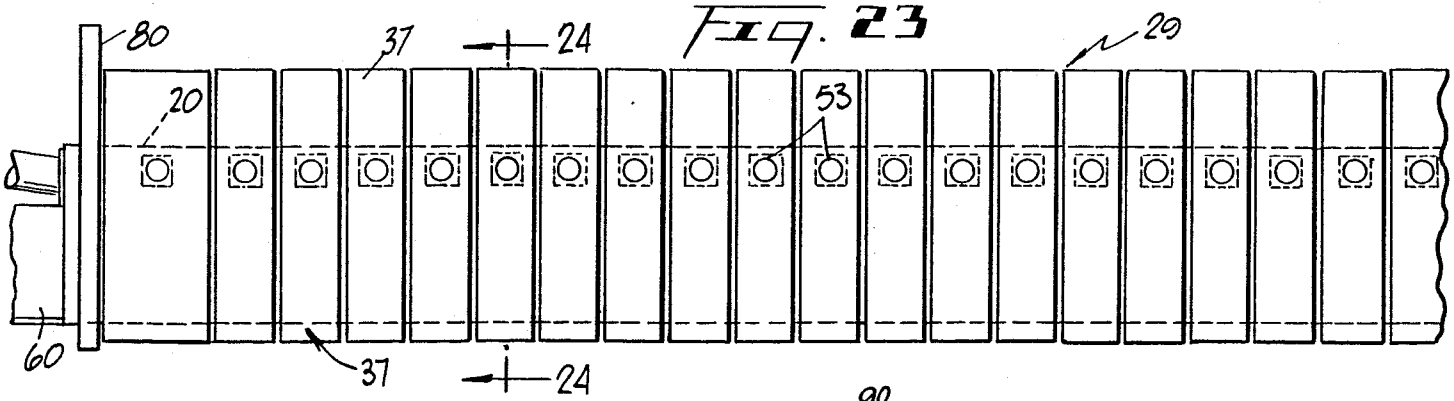
FIG. 23 is an enlarged view of a portion of FIGS. 3 and 4 showing a middle gas distributor.

As embodied herein, a horizontal baffle plate 97 extends through the frame 18 of each distributor 27, one on each side of the center baffle 40 (see FIGS. 20 and 21). The baffle plates 97 are formed with uniformly-sized and spaced openings which preferably are semicircular notches 99 along both sides thereof and each baffle plate slopes downwardly from the inlet end of the distributor 27 toward the center baffle 40, and each terminates at a terminal end which is below an orifice adjacent to and spaced from the center baffle 40. (See FIGS. 20 and 21.) Each baffle plate 97 is generally planar and spans the width of the frame 18 and one pair of notches 99 is aligned with each pair of orifices. Thus, gas entering the distributors 27 passes through inlet openings 101 formed by the baffle plates 97 and the sides and bottom of the distributor distributors 18. The gas flows beneath the baffle plates 97 and some passes upwardly through the notches 99 and then through the orifices and into the retort. The remainder of the gas passes through openings 104 below the terminal ends 100 and through openings 102 between the terminal ends 100 and the center baffles 40 and flows back toward the inlet openings 101 and above the baffles 97.

The baffle plates 97 are constructed and the notches 99 positioned and dimensioned to help control the gas temperature and pressure at each orifice and to provide sufficient cooling to the side walls of the distributor frame to meet the retort requirements. Importantly, the gas exiting the orifices adjacent the center baffles 40 is almost exclusively gas which has passed entirely under the horizontal baffles 97. On the other hand, the gas exiting the orifices toward the kiln walls is a mixture of hot gas which has passed entirely under the horizontal baffles 97 and cooler gas passing upwardly through the notches 99.

It has been determined that in order to insure that the temperature of the distributors remains substantially constant throughout, about two-thirds of the gas entering the distributors 27 through gas inlets 58 should pass under the horizontal baffles 97 and the remaining one-third should pass upwardly through the baffle orifices 99. In order to achieve this, it has been determined that the summation of the cross-sectional area (23 $in^2$) of the baffle orifices 99 in each baffle 97 should be from about 95% to about 125%, and preferably about 110%, of the cross sectional area of the opening 104 below the terminal end 100 of the baffle 97. In addition, it has been determined that the cross sectional areas (21 $in^2$) of openings 102, 104 should be approximately equal and from about 23% to about 32%, preferably about 28%, of the cross-sectional area (76 $in^2$) of gas inlet opening 101.

Distributor Placement

As described above, the distributors 27, 29 perform two main functions. They distribute gas uniformly to the rock bed and they disturb the rock particles. Optimally, in an oil shale retort, the distributors are from about 24' to about 26½' in length and include a gas-tight bulkhead (center baffles 40) at their center line. For distributors having orifice dimensions and clear space described above, baffle plates and center baffles at their midpoints, and gas and rock parameters also described above, the clear spacing between adjacent distributors 27 should be about 32" to insure that the gas emitted from the orifices infiltrates the entire rock bed uniformly. If the distributors 27 are placed any closer together, bridging of the rock between the distributors tends to occur.

The peaked configuration 88 at the top of the distributors 27, 29 eases the loading thereon by the descending rock and causes the rock bed to part and individual particles to change position exposing a variety of the rock surfaces to the gas. The rectangular bottom configuration allows a V-shaped trough to form in the descending rock bed so that horizontal flow of gas under the distributors 27, 29 is possible. This allows cross flow of gas in the kiln to correct potential gas channeling in the bed.

Liquid Cooled Distributors

It will be appreciated that in an oil shale retort, the temperature in the vicinity of the upper gas distributors 27 exceeds the coking temperature of oil produced from the shale. On some occasions, oil can coke on the outside of the distributors 27. This can cause the orifices to become clogged with carbonaceous material which impairs the operability of the retort. Therefore, in addition to the baffle plate 97 in the distributors, it is prudent to cool each individual orifice in the upper distributors 27.

In accordance with the invention, means is provided for cooling the orifices in the upper distributor. As embodied herein and shown in FIGS. 17 and 18, piping 35 extends along each distributor 27 on opposite sides of the center baffle 40. The piping 35 includes four channels each having a forward pass and a return pass along each distributor 27 on one side of the associated center baffle 40. The forward pass for pipe set 35A winds sinusoidally along the distributor 27 passing through the orifice blocks 33 adjacent each orifice along one side of the distributor 27. Similarly, the forward pass for pipe set 35B winds sinusoidally through frame 18 adjacent each orifice on the other distributor side. Return passes for each pipe set 35A, 35B extend through the insulation 38 within the armor plates 37.

Forward passes of pipe sets 35C and 35D, respectively, extend through insulation 38 above the distributors 18. Return passes for these pipe sets wind sinusoidally along opposite sides of the distributors generally parallel to the forward passes of pipe sets 35A, 35B and pass through the orifice blocks 33 on opposite sides of those orifices. The coolant in the return passes is, of course, substantially hotter than that in the forward passes. Coolant can be considered cool in the first two thirds of the forward passes, warm in the last third of the forward pass and first third of the return pass, and hot in the last two thirds of the return pass. Utilizing the design of the present invention, each orifice is cooled either by one cool pass or two warm passes.

The same is true for pipe sets of piping 35 located on the other side of each center baffle 40. Piping 35 conveys a suitable cooling medium such as 50% ethylene glycol and 50% water which moves continuously therethrough. By this construction, the metal temperature of the distributors 27 at the orifices can be maintained below the coking temperature of the shale oil.

Middle Distributors

Figure 28:
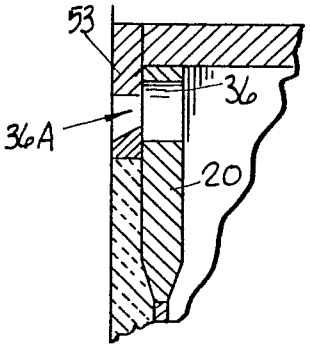
FIG. 28 is a portion of an enlarged sectional view of FIG. 26 taken along the line 28—28 thereof.
Figure 24:
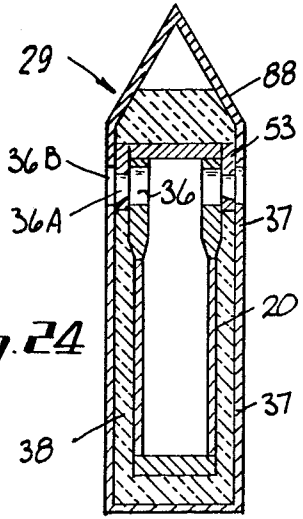
FIG. 24 is an enlarged sectional view of FIG. 23 taken along the line 24—24 thereof.

If the middle distributors 29 are employed, as indeed is preferable in the direct heated retort and optional in the indirect heated retort, they are similar in construction to the upper distributors 27 described above. Thus, as seen in FIGS. 23–28, the middle distributors 29 are formed by hollow, elongated, generally rectangular frames 20 (FIG. 24) which extend from end to end across the kiln 23 and are supported adjacent their ends in metal frames 80 within the side walls of the kiln (see FIGS. 23 and 26). Frames 20 are constructed of carbon steel and are formed with openings 36 spaced along their length (FIG. 28). An expanding nozzle 53 also constructed of carbon steel is welded to the frames 20 over each opening 36 and has a conically-shaped opening 36A aligned with respective openings 36, 36B in the frame and armor plate. Conically-shaped openings 36A are circular in cross section and incline downwardly at an angle of about 15° to the horizontal. The minimum diameter of the conically-shaped opening 36A is about 0.900". Armor plates 37 encompass the frames 20 and the space between the armor plates 37 and the frames 20 may be filled with insulation 38 (see FIG. 24). The armor plates 37 have peak-shaped tops 88 (FIG. 24) in the same manner as the armor plates 37 for distributors 27.

Figure 26:
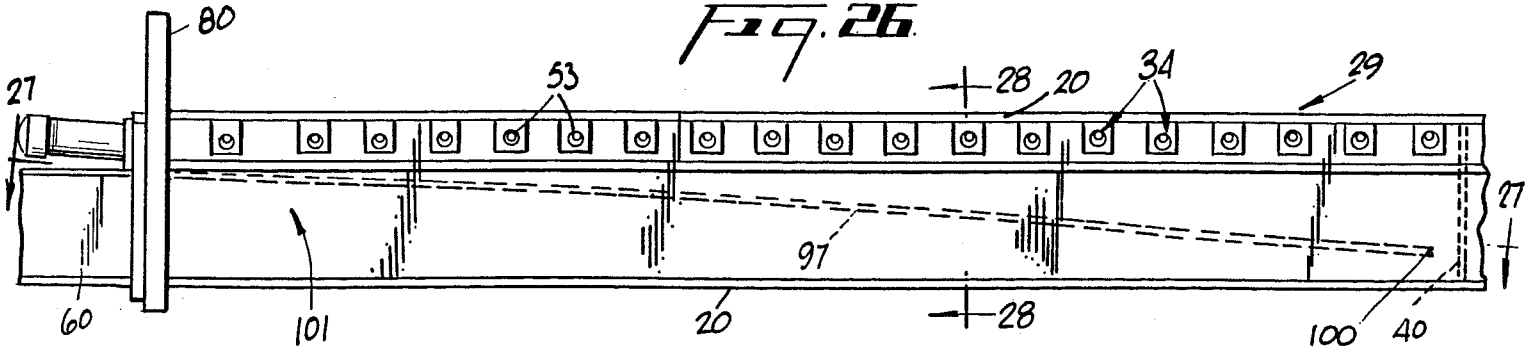
FIG. 26 is a view similar to FIG. 23 with parts omitted for clarity.
Figure 27:
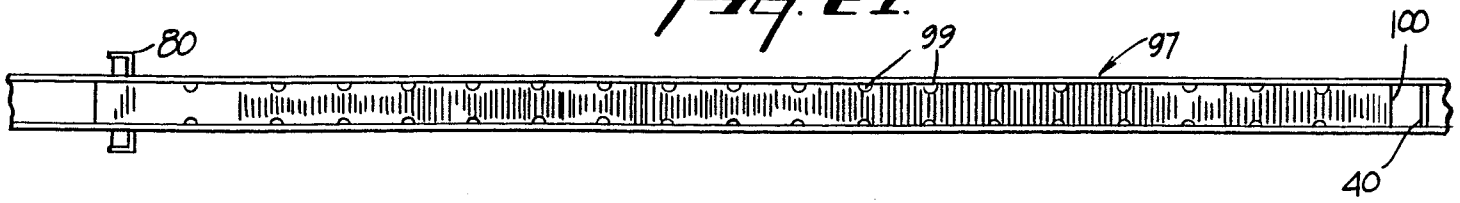
FIG. 27 is a sectional view of FIG. 26 taken along the line 27—27 thereof.

A divider or center baffle 40 separates the distributors 29 into two halves, and an internal horizontal baffle plate 97 inclines downwardly from a gas inlet opening 101 in each frame 20 and terminates at a terminal end 100 spaced from the center baffle 40 and below the set of orifices adjacent the center baffle 40 (see FIGS. 26 and 27). Each baffle plate 97 is provided with a plurality of equally spaced, semicircular notches 99 which align generally with the orifices.

Figure 25:
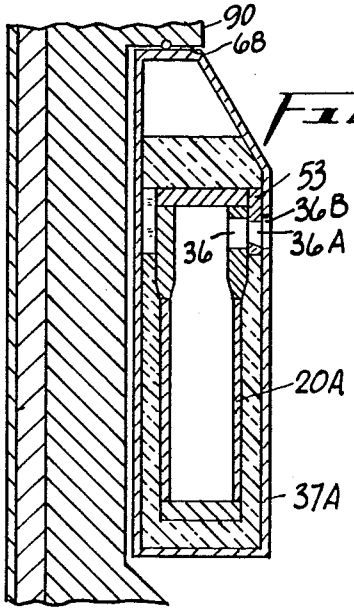
FIG. 25 is a view similar to FIG. 23 showing a distributor adjacent the retort side wall.

Like the construction of the upper distributors 27, the horizontal baffles 97 in the middle distributors 29 prevent excessive heating of the distributors at the center of the kiln. The construction of the middle distributors provides for uniform distribution of gas across the entire cross section of the kiln 23. The orifices are uniformly sized for easy maintenance and are substantially uniformly spaced except that the orifices straddling the center baffle 40 are spaced apart a slightly greater distance. The orifices adjacent to the side walls of the kiln 23 are slightly closer to the wall than half the spacing between the other orifices. The distributors 29A adjacent kiln end walls 90 are partially set into recesses 68 and the armor plates 37A therefor are tapered as shown in FIG. 25.

The configuration and dimensions of the orifices and the spacing there between, the configuration, length and spacing of the distributors 29 and the mechanical construction and function thereof, are substantially the same as described above for the distributors 27 and are not described further here. One exception is that because the retort temperature is somewhat lower in the area of the middle distributors 29 and liquid oil would not usually be present and thereby subject to coking, there generally is no need to provide cooling means for the distributor orifices. Thus, the cooling means for the orifices described above for the upper distributors 27 may be dispensed with here.

It has been determined that on all occasions in the direct heated oil shale retort when coking occurred on the middle gas distributors 29, the oil recovery equipment was overloaded or otherwise malfunctioning and the source of the oil which was coked is believed to be mist carried over through the recycle gas system. The primary oil recovery section (not shown) used with this invention, which includes coalescers and electrostatic precipitators, is designed to process 25% more throughput than is required to support the rated capacity of the retort. In addition, a knockout pot (not shown) is provided between the electrostatic precipitator and compressors to catch any "slugs" of oil which might be in the compressor inlets. Furthermore, a mist eliminator (not shown) and an electrostatic precipitator (not shown) are installed in the recycle gas line between the compressor and the middle gas distributors 29.

Segmented Distributors

Figure 29:
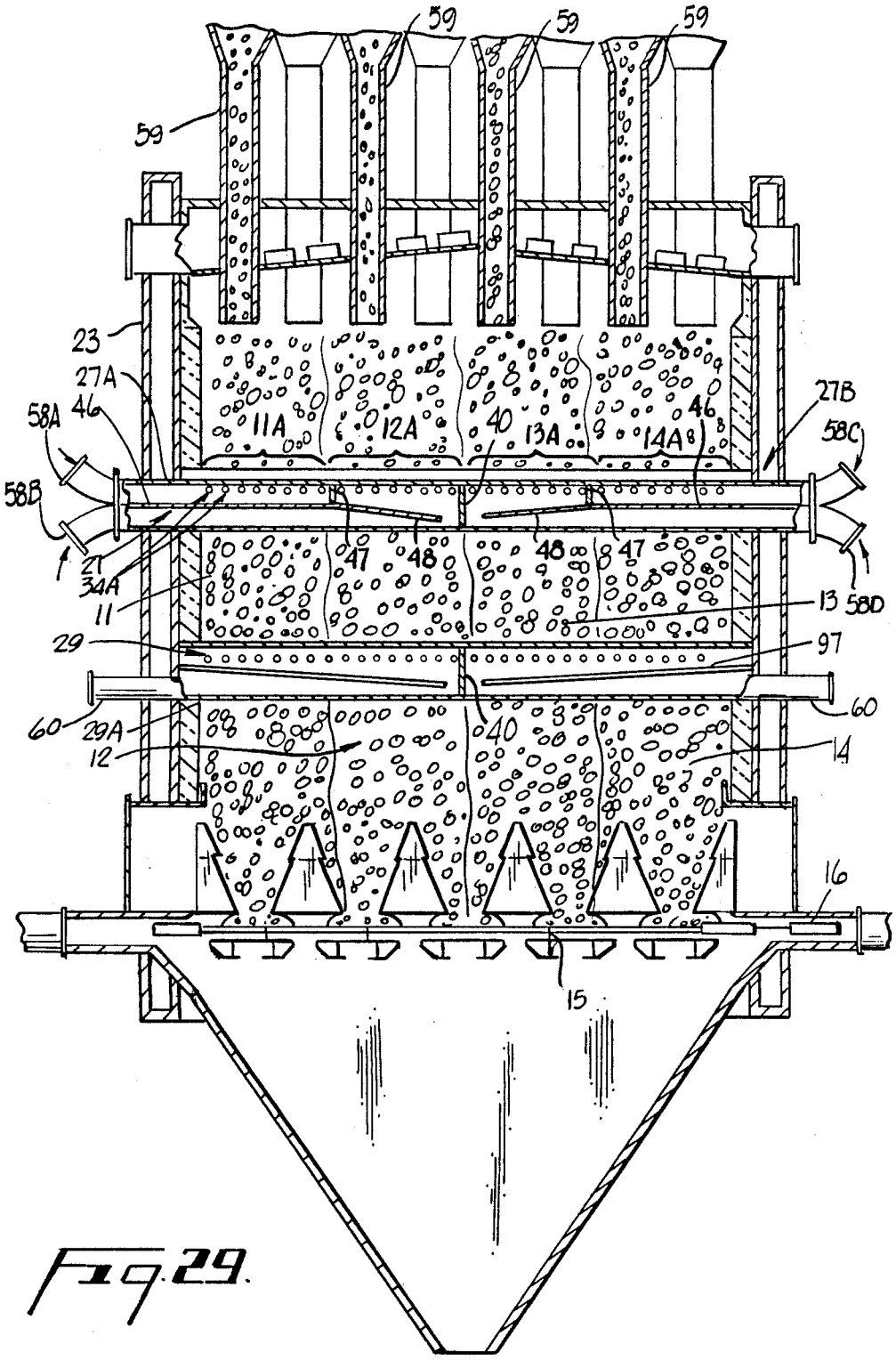
FIG. 29 is an enlarged view of a portion of FIG. 3 showing the filling zones in the retort for the rock particles and the relationship of the filling zones to segments of the gas distributors.

As previously described, the retort is filled with rock by a delivery means including a shuttle conveyor 91, a tripper conveyor 93, and a hopper 95 which make a plurality of (4) passes along the length of the kiln 23. Rock is continuously fed to the delivery means and despite efforts to maintain uniformity, different grades of rock can and will at times be delivered to the kiln. When this occurs, it produces non-uniform conditions in the rock bed which significantly affects the efficiency of the retorting process It will be appreciated that each pass of the rock delivery means delivers a layer of rock to a vertical filling zone in the kiln 23. Since there are four (4) passes of the delivery means, there are four vertical filling zones represented at 11, 12, 13, 14 in FIG. 29 and each is made up of layers of rock deposited during a pass of the delivery means. The zones 11–14 extend generally vertically through the kiln 23 and are shaped generally rectangularly in cross section. The rock layers extend horizontally of the kiln.

The multiple pass rock delivery means can be used to advantage such that variations in grade of rock or rock size which might exist on the tripper conveyor 93 would tend to be averaged out because of the "layers" of rock in the retort. However, it is desirable that the rock bed be uniform and when a different grade of rock enters one or more of the filling zones 11–14, it can act to the detriment of the retorting process especially if the segregation tends to form vertically. Furthermore, because of the long residence time of the rock on the feed belts and in the retort, it takes a relatively long time to correct an imbalance condition in the retort by changing the grade of rock delivered. It is important, therefore, that there be means for relatively fast reaction to non-uniform conditions in the rock bed to maintain uniformity in the retorting process.

In accordance with the invention, means is provided for varying the quantity of gas delivered to the vertical filling zones in the retort. As embodied herein and shown in FIG. 29, each of the upper distributors 27 is modified so that it is divided into four segments 11A, 12A, 13A, 14A, one corresponding to each of the four vertical filling zones 11–14. Gas is deliVered to distributor segment 11A through inlet 58A and to segment 12A through inlet 58B. The gas stream delivered to segments 11A and 12A is separated from one another by horizontal baffle 46 and vertical divider 47. In this construction, it has been found that an inclined baffle 48, corresponding substantially in structure to baffle 97 shown in FIGS. 20 and 21, is required only at distributor segment 12A and not at segment 11A.

In a similar fashion, gas is delivered to distributor segments 13A, 14A through inlets 58D, 58C, respectively. Segments 13A, 14A are separated by horizontal baffle 46 and vertical baffle 47 and an inclined baffle 48 is provided in segment 13A. The distributor is designed so that the gas velocity is greatest, and therefor the cooling effect is greatest, near the center of the kiln where the distributor is the hottest. A divider or center baffle 40 blocks the flow of gas past the midpoint of distributors 27.

It will be understood that the relative amounts of gas delivered to each of the distributor segments 11A–14A is readily varied by varying the amount of gas delivered to the inlets 58A, 58B, 58C, 58D. Thus, when an imbalance occurs in the rock bed such as, for example, the result of a different grade of rock in one or more of the filling zones 11–14, controlled variance of gas flow to the distributors 27 can quickly correct the situation so that process uniformity can be maintained. Preferably, the inlets 58A, 58B, 58C, 58D for each of the distributors 27A, 27B are controlled so that the proper amount of gas is delivered to corresponding segments of each distributor.

The distributors 29 in this embodiment are substantially the same as in the embodiment illustrated in FIGS. 23–28 and described above although it is understood that similar modifications to those described for distributors 27 could be employed here if desired.

A summary of the important fundamentals of the moving substances, both solids and fluids, in the present invention when retorting oil shale, is as follows. For the solids, i.e., shale lumps, there should be a consistent range and distribution of shale sizes which should be relatively free of fines, which are defined as particles smaller than ¼" average dimension across. The shale should be distributed uniformly over the entire cross section of the retort and the shale lumps should be disturbed at more than one level as they descend through the kiln to expose a variety of solid surfaces to the upwardly moving gas stream. Finally, the spent shale should be removed uniformly over the entire kiln cross section and at a controlled bulk rate.

For the fluids, cooling gas should be distributed uniformly over the entire kiln cross section below the bed. Air should be distributed uniformly and in a carefully controlled pattern over the entire kiln cross section, preferably at two levels with a different concentration of oxygen at each level, in the direct heated retort, to achieve a desired vertical temperature profile and to minimize horizontal temperature variations in the kiln. Gas (and entrained oil mist) should be removed from the top of the kiln in such a way as to promote uniform flow over the entire kiln cross section. The present invention achieves all of these fundamentals.

Figure 7:
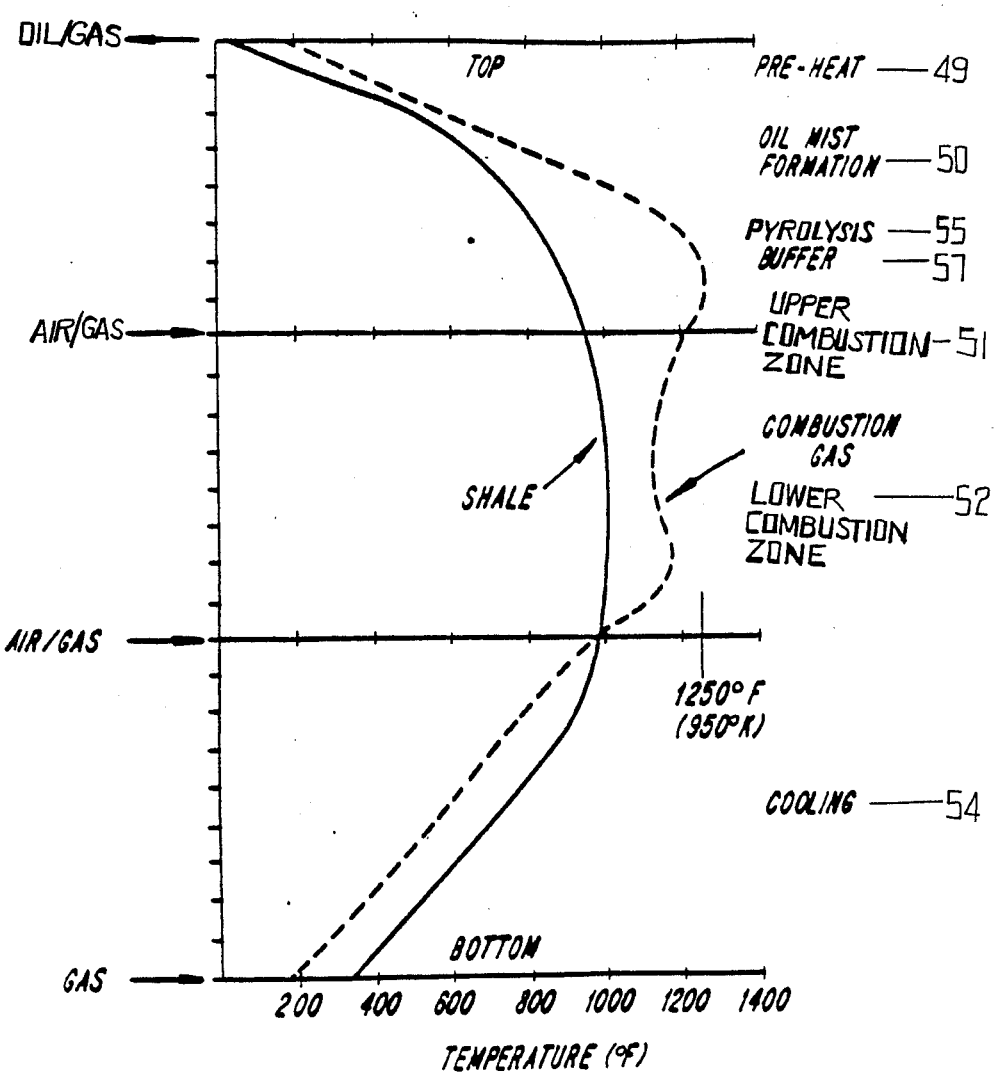
FIG. 7 is a chart illustrating the rock and gas temperatures in the various zones of the present invention.

The shale and gas temperatures achieved in the present invention are shown in FIG. 7. The temperature of the gas above the lower air/gas distributor 29 is higher than the temperature of the shale. In the cooling zone, the shale is hotter than the incoming recycle gas from the bottom distributors 31 so that heat flows from the shale to the gas here.

Figure 8:
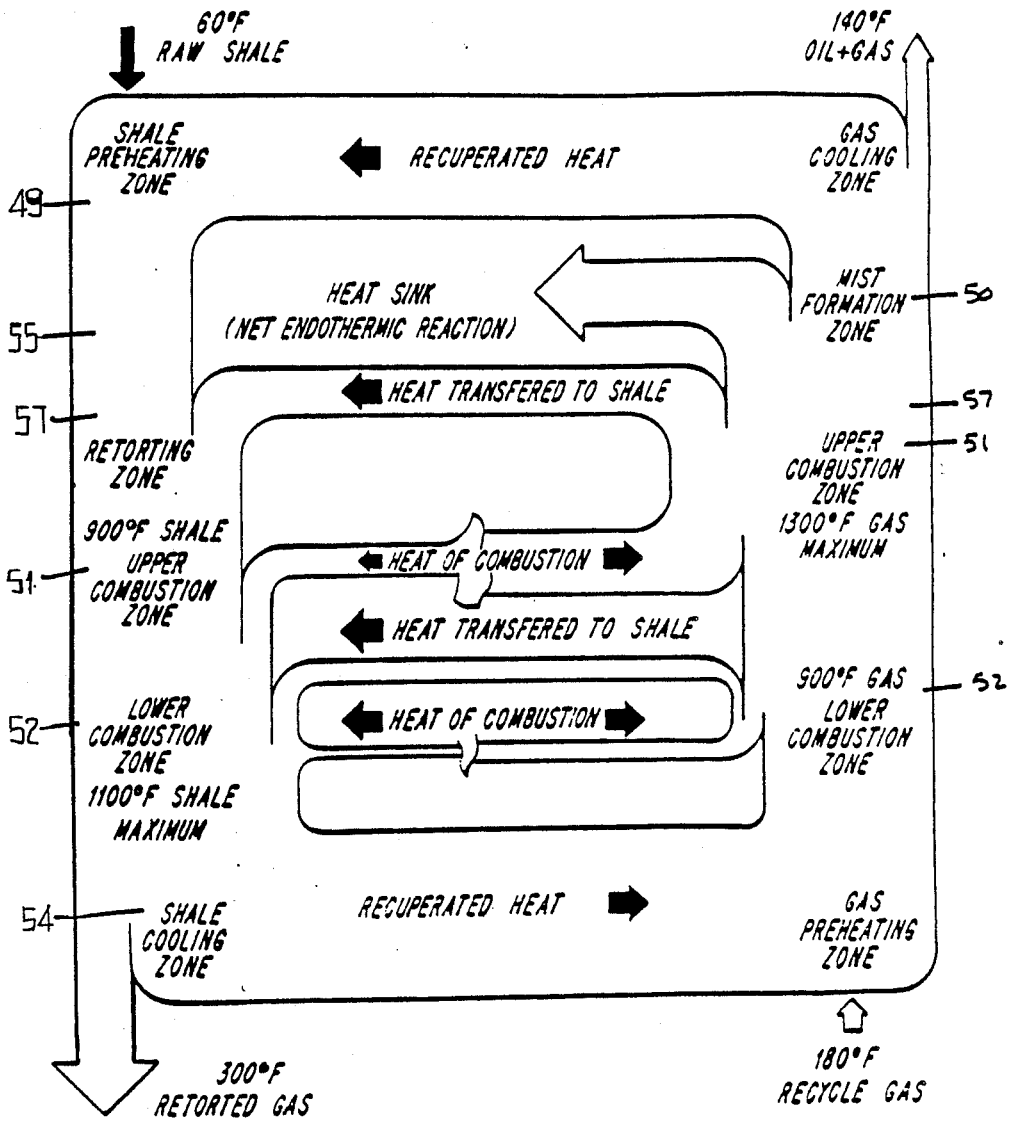
FIG. 8 is a diagram showing the desired heat flow in the present invention.

FIG. 8 is a desired heat flow diagram which shows how heat is physically distributed within the retort. The right side of this figure shows heat being transported upwardly by the moving gas. Horizontal paths show recuperated heat flowing from the gas to the shale in the upper part of the kiln and from the shale to the gas in the lower part. The make-up heat is provided by oxidation at two levels in the direct heated retort. The net heating is shown by a single arrow representing the net endothermic heat sink for the entire retort. This is the heat required to evaporate all the water, calcine a portion of the carbonate, destructively distill the kerogen and support the endothermic char gasification reactions.

Figure 9:
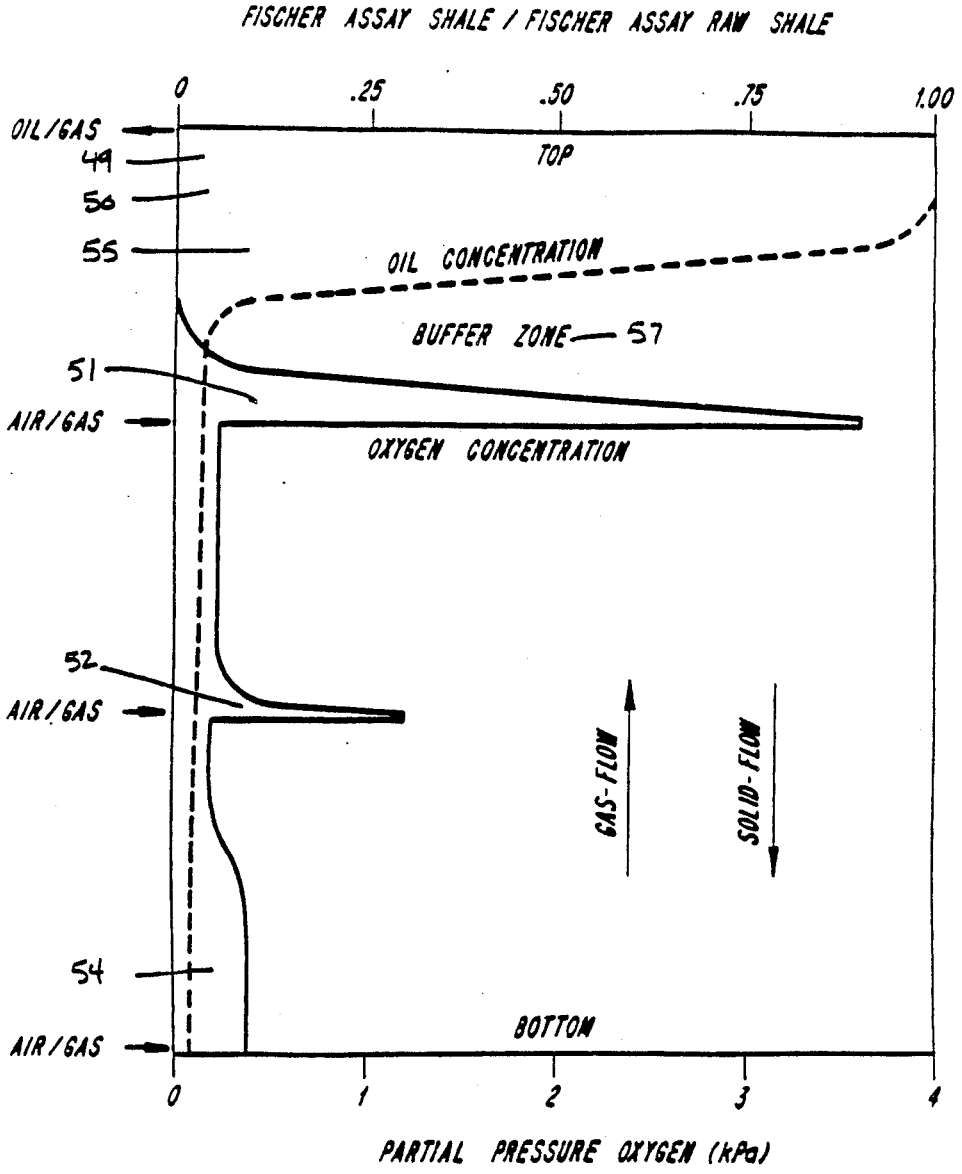
FIG. 9 is a diagram showing the concentration of oil and of oxygen throughout the various zones of the present invention.

The dashed curve of FIG. 9 shows the amount of potential oil in the shale at various elevations in the retort. The solid curve shows the oxygen level. The buffer zone 57 is below the level at which oil occurs in significant quantities. This buffer zone is important because any oil that contacts the oxygen at the temperature of the buffer zone is subject to oxidation to the extent of the amount of oxygen present.

It will be appreciated that the process of retorting oil shale is a thermal process which depends upon accurate maintenance of temperatures, pressures, residence times, gas compositions and flow rates within relatively narrow limits. These limits, in turn, depend upon the process and the materials being processed. In the present invention, heat is generated in the combustion zone 51, 52 in the direct heated retort, one located above each of the two air/gas distributors 27, 29. In the indirect heated retort, the externally heated gases are delivered to the retort at one or two or more levels. In both cases, heat may be thought of as being swept upwardly by the rising gas stream ream and at the same time being carried down by the descending shale lumps.

The temperatures in the kiln influence both the quantity and the quality of the oil produced. The maximum temperature in the kiln is dependent on the extent of decomposition of carbonate minerals in the shale, while the minimum temperature is determined by the time/-temperature relationships in destructively distilling the kerogen in the shale. In order to avoid excessive refluxing, (i.e. return of condensed oil to the pyrolysis zone) the shape of the vertical temperature profile in the mist formation zone is controlled by the gas-to-solids flow ratio in the upper part of the retort. Maintaining uniform and controlled processing conditions over large cross-sections required an innovative design. FIG. 2 shows a submodule (or cell) which has a multiplicity of feed bins, gas collecting orifices and ducts, multiple levels of gas and air distribution, and multiple shale withdrawal mechanisms. This cell could process over 2,500 tons of shale per day. By incorporating 8 of these cells in a linear fashion as shown in FIG. 1, a 20,000 ton per day retort could be built and operated. Second generation retorts would be wider and use 12 or more cells.

Temperature control in the present invention is a dynamic feedforward-feedback system adapted to maintain acceptable operating conditions between the maximum and the minimum profiles in each of some 82 temperature control zones. This takes into account all the independent variables which affect the retorting process. The most important variable in this category is the quality of the raw shale including the amount and nature of the kerogen, mineral carbonate and water content. Other independent variables in the control system include physical properties in the raw shale, recycle gas and combustion air.

The independent load variables in a commercial retort having 8 sub-modules that are used to establish tentative values for 8 classes of manipulated variables on a real time basis include the following:

16-Grate speeds
18-Bottom recycle gas flow rates
2-Middle air/gas ratios
82-Middle air/gas flow rates
1-Upper air/gas flow ratio
82-Upper air/gas flow rates
48-Steam flow rates to the bottom gas distributors
32-Top pressures
281-Total manipulated variables.

It will be apparent to those skilled in the art that various additions, substitutions, modifications and omissions may be made in the present invention without departing from the scope or spirit of the invention. Thus, it is intended that the present invention cover the additions, substitutions, modifications and omissions provided they come within the scope of the appended claims and their equivalents.

We claim:

1. Retorting apparatus comprising a kiln having a substantially rectangular cross section and adapted to have a bed of rock of mixed sizes and shapes descend as a moving bed continuously and generally vertically therethrough by gravity, means for delivering gas to the kiln for effecting heating of the rock to its destructive distillation temperature in a pyrolysis zone, means for delivering said rocks into said kiln above said pyrolysis zone consisting of a plurality of feed bins and a plurality of vertically extending circular feed tubes maintained substantially continuously full of rock and extending downwardly toward said pyrolysis zone, said tubes being substantially uniform in diameter and geometrically arranged so that imaginary lines connecting the centers of each adjacent group of three tubes form approximately equilateral triangles, said rock descending through the tubes and dispersing outwardly at differential rates proportional to the particle sizes, the rock from each tube interacting with the rock from adjacent tubes and with the kiln walls to form a plurality of uniformly and symmetrically disposed differentially permeable generally vertical paths, or "rock chimneys", through the descending bed of rock across the entire cross section of the kiln which offer least resistance to upward flow of gases through the descending rock, said rock chimneys being formed one at substantially the center of each equilateral triangle, said tubes being sized and arranged to form at least one rock chimney for each six square feet of kiln cross section.

2. The retorting apparatus of claim 1, said rock being oil shale lumps and in said pyrolysis zone will produce oil vapor by the destructive distillation of kerogen in the shale lumps, the retorting process producing hot gases which mix with hot gases in the kiln and flow upwardly in the kiln counter to the movement of said descending shale lumps, the upwardly flowing gases being operable to sweep the produced oil vapor upwardly therewith from said pyrolysis zone, said gas and oil vapor being cooled by the descending shale lumps above the pyrolysis zone causing oil vapor to condense and form a mixture of gas containing oil mist, means defining a delineated collection chamber above said pyrolysis zone and above the bottom of said tubes for collecting the gas and oil mixture rising through said rock chimneys being operable to disengage the gas and entrained oil at a low Reynolds number.

3. The retorting apparatus claimed in claim 2, said gas delivery means capable of delivering a mixture of air and recycle gas to said kiln to support oxidation of char in said kiln and defining a combustion zone in said kiln, said oxidation producing hot flue gases which mix with hot recycle gas and heat said shale above the combustion zone, said combustion zone and said pyrolysis zone being undelineated.

4. The retorting apparatus claimed in claim 3, including means for delivering recycle gas below said combustion zone, whereby said shale is cooled and said recycle gas is heated and rises toward said combustion zone.

5. The retorting apparatus of claim 2, wherein said collection chamber has a bottom formed with a plurality of uniformly arranged orifices which are aligned vertically with respective rock chimneys for receiving the gas and oil mist mixture rising through the chimneys.

6. The retorting apparatus claimed in claim 5, said collection chamber having off-take means disposed laterally thereof for removal of said mixed gas and oil, said orifices being sized so that the pressure drop through each orifice plus the pressure drop through the adjacent off-take means is substantially the same.

7. The retorting apparatus claimed in claim 5, said bottom of said collection chamber being formed by a tube sheet in said kiln above said pyrolysis zone, said orifices being located above said rock chimneys, said collection chamber having off-takes extending outwardly at opposite sides of said kiln for removal of said gas and oil mist mixture from said collection chamber, the orifices toward the center of said kiln being larger than those at the side near the off-takes whereby the pressure drop through each orifice plus the pressure drop through the orifice adjacent off-take is substantially the same.

8. The retorting apparatus claimed in claim 7, said tube sheet sloping downwardly from the center of said kiln toward the sides thereof adjacent said off-takes to promote draining of liquid to the off-takes.

9. The retorting apparatus claimed in claim 7, said means for delivering air and gas to said combustion zone including at least two vertically spaced means operable to deliver a rich gas mixture at the lower position and a lean gas mixture at the upper position.

10. The retorting apparatus claimed in claim 9, said delivering means including elongated air/gas distributors having a plurality of uniformly arranged orifices operable to provide a uniform spatial distribution of oxygen in said combustion zone.

11. The retorting apparatus claimed in claim 1, including grate means at the bottom of said kiln and operable to control the delivery rate of spent rock from said kiln.

12. The retorting apparatus claimed in claim 1, wherein each of said bins is connected to an upper end of a respective one of said feed tubes, the juncture between each of said bins and its respective feed tube including deflecting means operable to deflect rock fines toward the center of said tube.

13. The retorting apparatus claimed in claim 12, said bins being substantially rectangular in cross section and funneling downwardly toward said feed tubes, said deflecting means including an inwardly directed kink at substantially the juncture between each said bin and its respective tube.

14. The retorting apparatus claimed in claim 12, including means for delivering rock into said feed bins comprising a tripper conveyor, a shuttle conveyor and a traveling hopper which sequentially deliver rock to said bins above said feed tubes.

15. The retorting apparatus claimed in claim 14, said shuttle conveyor is arranged so as to lay down parallel strips of rock in reverse passes, whereby a strip of rock of greater permeability can be laid down over or adjacent an area of restricted flow of gas in said bed.

16. The retorting apparatus claimed in claim 1, wherein a plurality of submodules of said retorting apparatus are linearly combined to increase the total throughput of said rock.

17. In a retorting apparatus of the type comprising a vertical kiln adapted to have a bed of rock of mixed sizes and shapes descend continuously and generally vertically therethrough by gravity, means for delivering gas to said kiln to effect heating of the descending rock to its retorting temperature in a pyrolysis zone, means for delivering the rock uniformly to the kiln above the pyrolysis zone; the improvement wherein the gas delivery means comprises a plurality of upper gas distributor means and a plurality of lower gas distributor means, said upper gas distributor means parallel to said lower gas distributor means, each of said distributor means including an elongated, generally parallel distributor extending across the kiln and provided with a plurality of spaced orifices along the length thereof, the distributors being constructed and the orifices being sized and spaced to deliver gas uniformly throughout the cross section of the kiln, and means for cooling the orifices in said upper gas distributor means.

18. The improvement claimed in claim 17, including means for defining segments in at least some of said distributors, and means for varying the quantity of gas delivered to said segments to vary the relative amounts of gas delivered to different zones in the retort.

19. The improvement claimed in claim 17, wherein said orifices are formed in opposite sides of the distributors opposing the orifices in adjacent distributors.

20. The improvement claimed in claim 17, said cooling means including double-pass coolant conveying distributors extending along each side of said gas distributors and disposed on opposite sides of each said orifice.

21. In a retorting apparatus of the type comprising a vertical kiln adapted to have a bed of rock of mixed sizes and shapes descend continuously and generally vertically therethrough by gravity, means for delivering gas to said kiln to effect heating of the descending rocks to its retorting temperature in a pyrolysis zone; the improvement wherein the gas delivery means comprises a plurality of vertically spaced gas distributor means; each of said gas distributor means including an elongated distributor extending across the kiln and provided with a plurality of spaced orifices along the length thereof, the distributors being constructed and the orifices being sized and spaced to deliver gas uniformly through the entire cross section of the kiln, including dividers forming center baffles at substantially the midpoint of each of said distributors and blocking the flow of gas therethrough, said gas delivery means including means for delivering gas to opposite ends of said distributors.

22. The improvement claimed in claim 21, wherein said orifices are substantially uniform in size and are substantially uniformly spaced along the length of each of said distributor except that the orifices straddling said dividers are spaced apart a greater distance that the spacing between the other orifices.

23. In a retorting apparatus of the type comprising a vertical kiln adapted to have a bed of rock of mixed sizes and shapes descend continuously and generally vertically therethrough by gravity, means for delivering gas to said kiln to effect heating of the descending rocks to its retorting temperature in a pyrolysis zone, means for delivering the rock uniformly to the kiln above the pyrolysis zone; the improvement wherein the gas delivery means comprises a plurality of vertically spaced gas distributor means including an upper and lower set of gas distributors, each of said sets of distributor means including a plurality of elongated, generally parallel distributors extending across the kiln and provided with a plurality of spaced orifices along the length thereof, the distributors being constructed and the orifices being sized and spaced to deliver gas uniformly throughout the cross section of the kiln, including means for defining segments in at least some of said distributors and means for varying the quantity of gas delivered to said segments to vary the relative amounts of gas delivered to different zones in the retort, said rock delivery means operable to deliver said rock in zones along the length of said kiln by a plurality of reverse passes along said kiln length, said segments of said at least some said distributors corresponding to said rock delivery zones.

24. The improvement claimed in claim 23, said at least some of said distributors including the distributors of the upper set of distributor means.

25. In a retorting apparatus of the type comprising a vertical kiln adapted to have a bed of rock of mixed sizes and shapes descend continuously and generally vertically therethrough by gravity, means for delivering gas to said kiln to effect heating of the descending rock to its retorting temperature in a pyrolysis zone, means for delivering the rock uniformly to the kiln above the pyrolysis zone; the improvement wherein the gas delivery means comprises a plurality of vertically spaced gas distributor means; each of said gas distributor means including an elongated distributor extending across the kiln, said distributors including a hollow frame provided with a plurality of openings along opposite sides thereof, orifice blocks fixed to said frame at each said opening and having an opening aligned with said openings in said frame, and armor plate encompassing each said frame, said armor plate having openings therein aligned with at least some of the openings in said orifice blocks and said frame, the distributors being constructed and the openings in said frame, and the openings in said orifice blocks and the openings in said armor plate being sized and shaped to deliver gas uniformly throughout the entire cross section of the kiln.

26. The improvement claimed in claim 25, including insulation between portions of said armor plate and each of said frames.

27. The improvement claimed in claim 25, including a divider in each of said distributors forming a center baffle at substantially the midpoint thereof.

28. The improvement claimed in claim 25, said openings in said frame, said orifice blocks, and said armor plate defining said orifices, said orifices being substantially uniform in size and shape.

29. The improvement claimed in claim 28, including a divider in each of said distributors forming a center baffle at substantially the midpoint thereof, said distributors being fed with gas from opposite ends thereof, said openings in each of said frames being substantially equally spaced from one another except those openings in each of said frames adjacent said dividers being spaced apart a distance greater than the other openings in each of said frames, and said openings in each of said frames adjacent the walls of said kiln being spaced from said walls a distance less than half the distance between adjacent openings in each of said frames.

30. In a retorting apparatus of the type comprising a vertical kiln adapted to have a bed of rock of mixed sizes and shapes descend continuously and generally vertically therethrough by gravity, means for delivering gas to said kiln to effect heating of the descending rock to its retorting temperature in a pyrolysis zone, means for delivering the rock uniformly to the kiln above the pyrolysis zone; the improvement wherein the gas delivery means comprises a plurality of vertically spaced gas distributor means; each of said gas distributor means including an elongated distributor extending across the kiln and provided with a plurality of spaced orifices along the length thereof, the distributors being sized and spaced to deliver gas uniformly throughout the entire cross section of the kiln, said kiln being generally rectangular having side walls and end walls, said distributors extending across the width of said kiln, the distributors which are adjacent the end walls of said kiln being disposed in recesses in said end walls.

31. In a retorting apparatus of the type comprising a vertical kiln adapted to have a bed of rock of mixed sizes and shapes descend continuously and generally vertically therethrough by gravity, means for delivering gas to said kiln to effect heating of the descending rock to its retorting temperature in a pyrolysis zone; the improvement wherein the gas delivery means comprises a plurality of elongated, generally parallel distributors extending across the kiln and provided with a plurality of spaced orifices along the length thereof, each of said distributors including a plurality of gas distribution segments corresponding to and aligned with gas distribution segments of each of the other distributors, and means for varying the quantity and makeup of the gas delivery to each of said distributor segments, said distributors including means at substantially the midpoint of each of said distributor blocking flow of gas therethrough, and means for delivering gas to each end of each of said distributors.

32. In a retort of the type comprising a vertical kiln adapted to have a bed of rock of mixed sizes and shapes descend continuously and generally vertically therethrough by gravity, means for delivering gas to said kiln to effect heating of the descending rock to its retorting temperature in a pyrolysis zone, and means for delivering the rock to the kiln above the pyrolysis zone; the improvement wherein the gas delivery means comprises a plurality of elongated distributors extending across the kiln and provided with a plurality of spaced orifices along the length thereof, said distributors, being open at their ends for the reception of gas, a divider in each of said distributors at substantially the midpoint thereof forming a center baffle blocking the flow of gas therethrough, a horizontal baffle in at least some of said distributors on either side of said center baffle and below said orifices, each said horizontal baffle sloping downwardly toward said center baffle and having a terminal end spaced from said center baffle, a plurality of orifices in said horizontal baffles, whereby gas entering the ends of said at least some distributors flows below the horizontal baffles in a direction toward said center baffles, some of the gas passing upwardly through the orifices in said horizontal baffles and the remainder between the terminal end of said horizontal baffles and said center baffles, said gas exiting said distributors through the orifices therein.

33. The improvement claimed in claim 32, said orifices in said horizontal baffles being semicircular notches formed in opposite edges thereof.

34. The improvement claimed in claim 32, said horizontal baffles engaging the sides of said at least some of said distributors and being spaced above the bottom thereof, the summation of the cross-sectional areas of the orifices in each said horizontal baffle being from about 95% to about 125% of the cross-sectional area of an opening below the baffle terminal end and of the cross-sectional area of the opening between the baffle terminal end and the center baffle.

35. The improvement claimed in claim 34, the summation of the cross-sectional areas of the orifices in each said horizontal baffle being about 110% of the cross-sectional area of the opening below the baffle terminal end and of the cross-sectional area of the opening between the baffle terminal end and the center baffle.

36. The improvement claimed in claim 32, said horizontal baffles being generally planar.

37. The improvement claimed in claim 32, said distributors, said horizontal baffles, and said baffle orifices being constructed so that approximately two thirds of the gas entering each said distributors passes under said horizontal baffles and past the terminal end thereof and approximately one third passes upwardly through said baffle orifices.

38. The improvement claimed in claim 32, each of said horizontal baffles together with the sides and bottom of respective distributors defining gas inlet openings by which gas enters the area below said horizontal baffles, the cross-sectional area of the openings formed below the baffle terminal ends and between the baffle terminal ends and the center baffles being from about 23% to about 32% of the cross-sectional area of the gas inlet openings.

39. The improvement claimed in claim 38, the cross-sectional area of the openings below said baffle terminal ends and between said baffle terminal ends and said center baffles being about 28% of the cross-sectional area of said inlet openings.

40. The improvement claimed in claim 38, the cross-sectional area of the openings below the terminal ends of the horizontal baffles being substantially equal to the cross-sectional area of the openings between the baffle terminal ends and the center baffles.

41. The improvement claimed in claim 32, the cross-sectional area of the openings below the baffle terminal ends and between the baffle terminal ends and the center baffles being substantially equal.

* * * * *